US005834899A

United States Patent [19]

Lovell et al.

[11] Patent Number: 5,834,899

[45] Date of Patent: Nov. 10, 1998

[54] FLUORESCENT APPARATUS AND METHOD EMPLOYING LOW-FREQUENCY EXCITATION INTO A CONDUCTIVE-RESISTIVE INDUCTIVE MEDIUM

[75] Inventors: Walter C. Lovell, Wibraham, Mass.; Edward Duhon, Setauket, N.Y.

[73] Assignee: Tapeswitch Corporation of America, Farmingdale, N.Y.

[21] Appl. No.: 729,365

[22] Filed: Oct. 16, 1996

[51] Int. Cl.[6] ..... H05B 37/02

[52] U.S. Cl. ..... 315/41; 315/248; 315/46

[58] Field of Search ..... 315/248, 39, 41, 315/46

[56] References Cited

U.S. PATENT DOCUMENTS

| | | | |
|---|---|---|---|
| 4,005,330 | 1/1977 | Glasscock, Jr. et al. | 315/248 |
| 4,758,815 | 7/1988 | Lovell . | |
| 4,823,106 | 4/1989 | Lovell . | |
| 4,899,088 | 2/1990 | Black, Jr. et al. . | |

(List continued on next page.)

FOREIGN PATENT DOCUMENTS

| | | |
|---|---|---|
| 0 358 502 A1 | 3/1990 | European Pat. Off. . |
| 0 361 748 A1 | 4/1990 | European Pat. Off. . |
| 0 560 255 A1 | 9/1993 | European Pat. Off. . |
| 0 593 312 A2 | 4/1994 | European Pat. Off. . |
| 0 647 086 A1 | 4/1995 | European Pat. Off. . |

OTHER PUBLICATIONS

Theodore Baumeister et al, Editor, *Marks' Standard Handbook for Mechanical Engineers* 12–119 through 12–121 (8th Ed., 1978).

7 *McGraw–Hill Encyclopedia of Science and Technology* 210–212 (6th Ed. 1987).

Alphonse J. Sistino, *Essentials of Electronic Circuitry* 42–47 (1996).

(List continued on next page.)

*Primary Examiner*—Robert J. Pascal
*Assistant Examiner*—Michael Shingleton
*Attorney, Agent, or Firm*—Hoffmann & Baron, LLP

[57] ABSTRACT

A fluorescent illuminating apparatus includes a translucent housing with a chamber within which a fluorescent medium is supported. The fluorescent medium and housing may be part of an ordinary fluorescent lightbulb. The housing has electrical connections configured to provide an electrical potential across the chamber. An inductive structure is fixed sufficiently proximate to the housing to induce fluorescence in the fluorescent medium when an electric current is passed through the inductive structure while an electric potential is applied across the electrical connections of the housing. It is believed that the inductive structure induces fluorescence by means of an electromagnetic field interaction with either the fluorescent medium, or the ultraviolet-emitting gaseous material, such as mercury, typically contained in a fluorescent lightbulb, or both. Preferred inductive structures for use with the present invention include elongate tape structures having a substrate with a conductive-resistive coating such as a solid emulsion of an electrically conductive material (e.g., graphite) dispersed in a non-conductive continuous phase. A coating portion of magnetic recording tape can also be used. Elongate conductor strips are provided, along edges of the substrate, in electrical contact with the conductive-resistive coating. A method of inducing fluorescence comprises passing a current through an inductive structure which is adjacent a fluorescing medium in an amount sufficient to induce fluorescence in the fluorescing medium in the presence of an electrical potential imposed on the fluorescing medium. The present invention replaces conventional ballasts.

41 Claims, 19 Drawing Sheets

U.S. PATENT DOCUMENTS

| | | | |
|---|---|---|---|
| 4,928,038 | 5/1990 | Nerone . | |
| 4,945,278 | 7/1990 | Chern . | |
| 4,972,126 | 11/1990 | Nilssen . | |
| 5,180,900 | 1/1993 | Lovell . | |
| 5,300,860 | 4/1994 | Godyak et al. . | |
| 5,381,073 | 1/1995 | Godyak et al. . | |
| 5,382,879 | 1/1995 | Council et al. | 315/248 |
| 5,385,785 | 1/1995 | Lovell . | |
| 5,412,286 | 5/1995 | Kazi et al. . | |
| 5,434,476 | 7/1995 | Franke . | |
| 5,466,992 | 11/1995 | Nemirow et al. . | |
| 5,494,610 | 2/1996 | Lovell . | |
| 5,495,405 | 2/1996 | Fujimura et al. . | |

OTHER PUBLICATIONS

10 *McGraw–Hill Encyclopedia of Science and Technology* 295, 299–300 (6th Ed. 1987).

Teccor Catalog Sales Sheets on Sidacs, pages not numbered, undated.

Kingtec Electronic Ballast Catalog, p. 8, place of publication unknown, date of publication on or before Apr. 1997, author unknown.

National Lighting Product Information Program Specifier Report: Dimming Electronic Ballasts, pp. 1,16,20 and composite p. 9, author unknown, place of publication Troy, New York.

FLUORESCENT APPARATUS AND METHOD EMPLOYING LOW-FREQUENCY EXCITATION INTO A CONDUCTIVE-RESISTIVE INDUCTIVE MEDIUM

BACKGROUND OF THE INVENTION

The present invention relates generally to fluorescent illuminating devices, and, more particularly, to an inductive fluorescent apparatus and method.

Fluorescent lamps are well known in the prior art. There are three basic types of such lamps. These are the preheat lamp, the instant-start lamp, and the rapid-start lamp. In each type of lamp, a glass tube is provided which has a coating of phosphor powder on the inside of the tube. Electrodes are disposed at opposite ends of the tube. The tube is filled with an inert gas such as argon and a small amount of mercury. Electrons emitted from the electrodes strike mercury atoms contained within the tube, causing the mercury atoms to emit ultraviolet radiation. The ultraviolet radiation is absorbed by the phosphor powder, which in turn emits visible light via a fluorescent process.

The differences between the three types of lamp generally relate to the manner in which the lamp is initially started. Referring now to FIG. 1, in a preheat lamp circuit, designated generally as 10, a starter bulb 12 is included. Preheat lamp 14 includes first and second electrodes 16 and 18, each of which has two terminals 20. During initial start-up of the preheat lamp, starter bulb 12, which acts as a switch, is closed, thus shorting electrodes 16 and 18 together. Current therefore passes through electrode 16 and then through electrode 18. This current serves to preheat the electrodes, making them more susceptible to emission of electrons. After a suitable time period has elapsed, during which the electrodes 16, 18 have warmed up, the starter bulb 12 opens, and thus, an electric potential is now applied between electrodes 16 and 18, resulting in electron emission between the two electrodes, with subsequent operation of the lamp.

A relatively high voltage is applied initially for starting purposes. A lower voltage is used during operation. A reactance must be placed in series with the lamp to absorb any difference between the applied and operating voltages, in order to prevent damage to the lamp. The reactance, suitable transformers, capacitors, and other required starting and operating components are contained within a device known as a ballast (designated generally as 22). Ballasts are relatively large, heavy and expensive, with inherent efficiency limitations and difficulties in operating at low temperatures. The components within ballasts are typically potted with a thermally conductive, electrically insulating compound, in an effort to dissipate the heat generated by the components of the ballast. Difficulties in heat dissipation are yet another disadvantage of conventional ballasts.

Referring now to FIG. 2, an instant-start lamp circuit, designated generally as 24, is shown. Instant-start lamp 26 includes first and second electrodes 28 and 30. Electrodes 28 and 30 each only have a single terminal designated as 32. In operation of the instant-start lamp, no preheating of the electrodes is required. Rather, an extremely high starting voltage is applied in order to induce current flow without preheating of the electrodes. The high starting voltage is supplied by a special instant-start ballast, designated generally as 34. Instant-start type ballasts suffer from similar disadvantages to those of the preheat type. Further, because of the danger of the high starting voltage from the instant-start ballast 34, a special disconnect lamp holder 36 must be employed in order to disconnect the ballast when the lamp 26 is not properly secured in position.

Referring now to FIG. 3, a rapid-start lamp circuit, designated generally as 38, is shown. Rapid start lamp 40 includes first and second electrodes 42, 44, each of which has two terminals 46, similar to the preheat lamp 14, discussed above. The rapid-start ballast, designated generally as 48, contains transformer windings which continuously provide the appropriate voltage and current for heating of the electrodes 42, 44. Rapid heating of electrodes 42, 44 permits relatively fast development of an arc from electrode 42 to electrode 44 using only the applied voltage from the secondary windings present in ballast 48. The rapid start ballast 48 permits relatively quick lamp starting, with smaller ballasts than those required for instant-start lamps, and without flicker which may be associated with preheat lamps. Further, no starter bulb is required. However, ballast 38 is still relatively large, heavy, inefficient, and unsuitable to low ambient-temperature operation. Dimming and flashing of rapid-start lamps are possible, albeit with the use of special ballasts and circuits.

It will be appreciated that operation of the prior art lamps described above is dependant on heating of the electrodes and/or application of a high voltage between the electrodes in order to start the operation of the lamp. This necessitates the use of ballasts and associated control circuitry, having the undesirable attributes discussed above. Recently, there has been interest in employing other physical phenomena to enable efficient starting and operation of fluorescent lamps. For example, EPO Publication Number 0 593 312 A2 discloses a fluorescent light source illuminated by means of an RF (radio frequency) electromagnetic field. However, the device of the '312 publication still suffers from numerous disadvantages, including the complex circuitry required to generate the RF field and the potential for RF interference.

There is, therefore, a need in the prior art for an inductive fluorescent apparatus and method which permits simple, economical starting and operation of fluorescent lamps with low-cost, light weight, low-volume components which are capable of efficiently operating the lamp, even at relatively low ambient temperatures, which afford efficient heat dissipation, and which are capable of operating at ordinary household A.C. frequencies.

SUMMARY OF THE INVENTION

The present invention, which addresses the needs of the prior art, provides an inductive fluorescent apparatus and method. The apparatus includes a translucent housing having a chamber for supporting a fluorescent medium, and having electrical connections configured to provide an electrical potential across the chamber. A fluorescent medium is supported within the chamber. An inductive structure is fixed sufficiently proximate to the housing in order to induce fluorescence in the fluorescent medium when an electric current is passed through the inductive structure, while an electric potential is applied across the housing.

In a preferred embodiment, the translucent housing and fluorescent medium are contained as part of a conventional fluorescent lightbulb. The inductive structure includes first and second spaced (preferably elongate) conductors, with a conductive-resistive medium electrically interconnected between the conductors. The conductive-resistive medium may be, for example, a solid emulsion consisting of an electrically conductive discrete phase dispersed within a non-conductive continuous phase. A preferred emulsion includes powdered graphite and an alkali silicate (such as china clay) dispersed in a polymeric binder. The medium may also be a coating portion of a magnetic recording tape.

The conductive-resistive medium may be located on a separate substrate, or may be applied to the surface of the fluorescent lightbulb itself Further, the inductive structure may be positioned in thermal communication with the translucent housing in order to aid in low-temperature operation of the inductive fluorescent apparatus, by means of transferring ohmic heat from the inductive structure to the translucent housing. (Even when there is no such heat transfer, the present invention provides better low-temperature operation than a conventional ballast.) It is believed that the inductive structure of the invention assists in starting and operation of the fluorescent lightbulb by means of an electromagnetic field interaction.

The method of the present invention includes passing a current through an inductive structure which is adjacent a fluorescing medium, in an amount sufficient to induce fluorescence in the presence of an electric potential imposed on the fluorescing medium. Preferably, the inductive structure comprises a conductive-resistive medium electrically interconnected between first and second spaced (most preferably elongate) conductors. The conductive-resistive medium is preferably maintained within about one inch or less of the fluorescing medium, at least for starting purposes, in order to maximize the electromagnetic field interaction between the inductive structure and the fluorescing medium. In alternative embodiments discussed herein, the inductive structure may be maintained at a greater distance from the fluorescing medium.

Various types of conductive-resistive media are described in detail in Applicants' U.S. Pat. Nos. 4,758,815; 4,823,106; 5,180,900; 5,385,785; and 5,494,610. The disclosures of all of the foregoing patents are incorporated herein by reference. Specific details regarding preferred media for use with the present invention are given herein.

As a result of the foregoing, the present invention provides an inductive fluorescent apparatus and method offering relatively low weight, low volume, simplicity and low cost compared to prior ballast-operated systems. The apparatus is capable of low-ambient-temperature operation, which may be enhanced by configuring the inductive apparatus to generate ohmic heat and transfer at least a portion of the heat into the fluorescent lamp. Inductive structures which are relatively thin and which have a relatively large surface area can be fabricated according to the invention, resulting in efficient heat dissipation.

The invention further provides a method of inducing florescence via electromagnetic field interaction between an inductive structure and a fluorescent lamp. The method can be carried out using reliable, compact, light weight and inexpensive hardware according to the present invention, and is potentially capable of greater efficiency than prior art methods (see Example 13 below).

For better understanding of the present invention, together with other and further objects and advantages, reference is made to the following description, taken in conjunction with the accompanying drawings, and its scope will be pointed out in the appended claims.

DETAILED DESCRIPTION OF THE INVENTION

Figure 4:
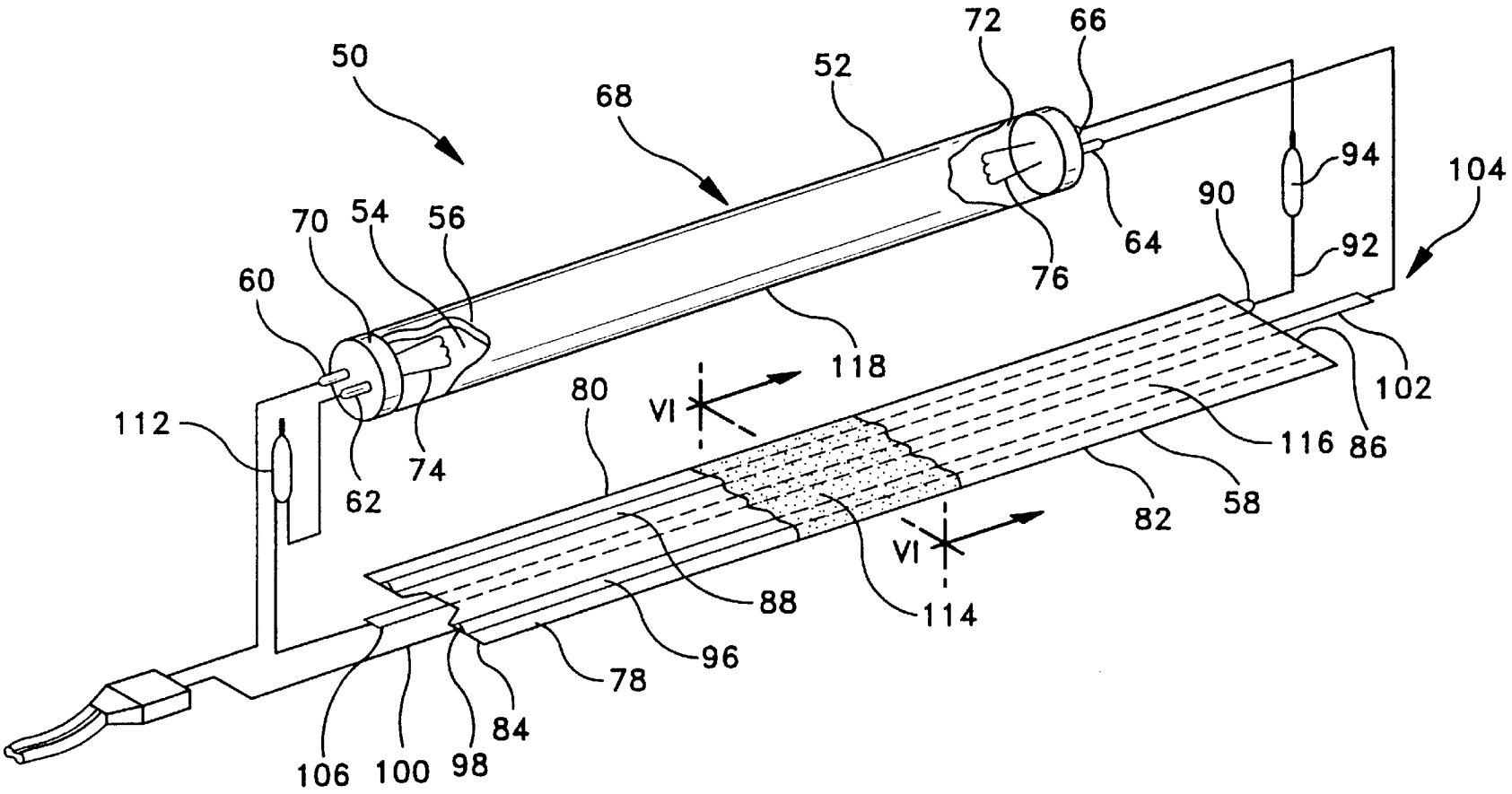
FIG. 4 is a perspective view of a first embodiment of the present invention employing a preheat type bulb along with an inductive structure made from conductive-resistive material.

Referring to the drawings, FIG. 4 shows a first embodiment of an inductive fluorescent apparatus 50. The apparatus includes a translucent housing 52 having a chamber 54. A fluorescent medium 56 is supported within chamber 54. An inductive structure such as conductive-resistive medium and substrate assembly 58 is fixed sufficiently proximate to housing 52 so as to induce fluorescence in fluorescent medium 56 when an electric current is passed through assembly 58 while an electric potential is applied across housing 52. Appropriate electrical connections such as first, second, third and fourth electrical terminals 60, 62, 64 and 66 are present on housing 52 for providing the electric potential across chamber 54.

As used herein, the term "inductive structure" is intended to refer to an electrical structure which is capable of inducing fluorescence in a fluorescent medium when an electric current is passed through the structure, while the structure is in proximity to the fluorescent medium, and while an electric potential is applied across the fluorescent medium. As noted below, it is believed that the inductive structures disclosed herein work by means of an electromagnetic field interaction with the contents of the fluorescent bulb per se. The term "inductive structure" is not intended to refer to inductive reactances, transformer coils, etc., which may be found in a conventional ballast, and which do not exhibit the properties of the present invention, i.e., the apparent electromagnetic field interaction with the contents of the fluorescent bulb.

Most preferably, housing 52 and fluorescent medium 56 form part of a preheat-type fluorescent lightbulb 68. Housing 52 preferably has first and second ends 70 and 72. As discussed above, in bulb 68, translucent housing 52 would be in the form of a hollow tube (preferably glass) having inside and outside surfaces with fluorescent medium 56 (typically, a fluorescent powder such as a phosphor powder) being coated onto the inside surface.

Bulb 68 preferably includes first and second electrodes 74, 76 disposed in spaced-apart relationship in housing 52, and most preferably located at first and second ends 70, 72 of housing 52 respectively. First electrode 74 is preferably connected across first and second terminals 60, 62, while second electrode 76 is preferably connected across third and fourth terminals 64, 66. Bulb 68 typically includes a quantity of gaseous material within housing 52, with the gaseous material (preferably mercury) being capable of emitting ultraviolet radiation when struck by electrons emanating from one of the electrodes 74,76. Fluorescent medium 56 fluoresces in response to the ultraviolet radiation.

Conductive-resistive medium and substrate assembly 58 (shown it its preferred form as an elongate tape structure) preferably includes substrate 78, which is preferably an electrically insulating material such as 0.002 inch polyester film. Substrate 78 preferably has top edge 80, bottom edge 82, left edge 84 and right edge 86. An elongate top conductor strip 88 is preferably secured to substrate 78 adjacent top edge 80, and preferably has a first exposed end 90 forming a fifth electrical terminal 92 adjacent right edge 86 of substrate 78. Fifth terminal 92 is preferably electrically interconnected with fourth terminal 66, preferably through fusible link 94 (for safety reasons).

Assembly 58 preferably also includes an elongate bottom conductor strip 96 which is secured to substrate 78 adjacent bottom edge 82, and which has a first exposed end 98 forming a sixth electrical terminal 100 adjacent left edge 84 of substrate 78. Second and third electrical terminals 62,64 are electrically interconnected through a starter switch such as starter bulb 112. In lieu of a starter bulb, a semiconductor power switch such as a thyristor device (e.g., a "SIDAC") may be employed for any of the applications herein where a starter bulb is employed. Any type of appropriate wiring may be used to connect starter bulb 112 between terminals 62,64. However, it has been found to be convenient to provide a connection in the form of intermediate conductor strip 102 having first exposed end 104 and second exposed end 106. Intermediate conductor strip 102 can be fastened to substrate 78 intermediate top and bottom conductor strips 88 and 96 and on an opposite side therefrom, and intermediate strip 102 can be electrically insulated from the remainder of conductive-resistive medium and substrate assembly 58 and can be covered by bottom cover film 117 (see FIG. 6). First and second exposed ends 104,106 of intermediate conductor strip 102 may be electrically interconnected with third electrical terminal 64 and second electrical terminal 62 respectively.

Figure 6A:
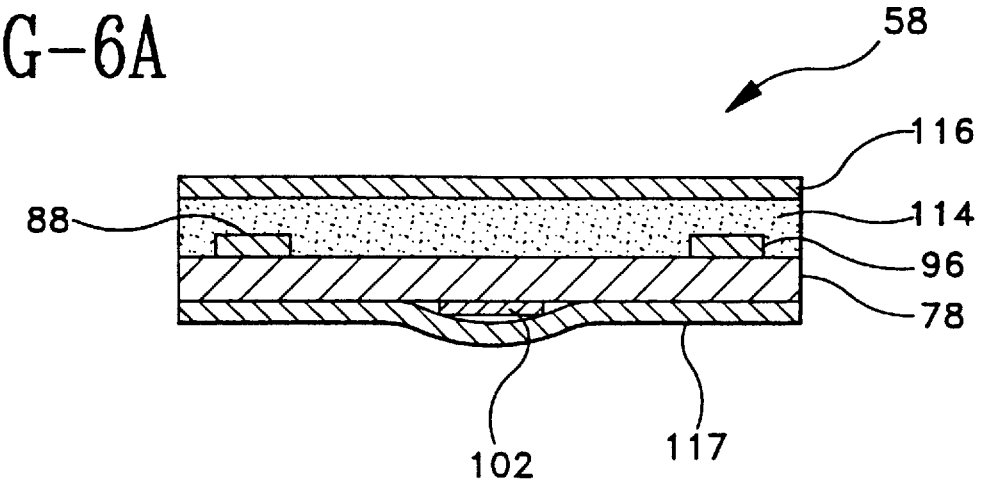
FIG. 6A is a cross-sectional view through the inductive structure of FIG. 4 taken along line VI—VI of FIG. 4.

Conductive-resistive coating 114 is located on substrate 78, and is electrically interconnected with top and bottom conductor strips 88,96. FIG. 6A shows a cross section through conductive-resistive medium and substrate assembly 58. Assembly 58 may be covered with a suitable cover film 1 16, preferably of an electrically insulating material such as polyester.

A number of materials are suitable for forming conductive-resistive coating 114. In general, suitable materials will include a non-continuous electrically conductive component suspended in a substantially non-conductive binder. Typically, the material constitutes a solid emulsion comprising an electrically conductive discrete phase dispersed within a non-conductive continuous phase. U.S. Pat. No. 5,494,610 to Walter C. Lovell, a named inventor herein, sets forth a variety of medium-temperature conductive-resistant (MTCR) coating compositions suitable for use as coating 114. The disclosure of this patent has been previously incorporated herein by reference.

Typically, the MTCR materials are prepared by suspending a conductive powder in a polymer based activator and water; the material is applied to a substrate and allowed to dry. A preferred conductive powder is graphite powder with a mesh size of 150–325 mesh. The activator can be a water-based resin dispersion such as a latex paint; for example, polyvinyl acetate latex. A graphite slurry can be formed of about 10–30 weight percent graphite (preferably about 15–25 weight %), about 22–32 weight percent water, and about 48–58 weight percent of a high-temperature polymer-based activator. Alternatively, the graphite slurry can be formed of about 10 to about 30 weight percent graphite (preferably about 15–25 weight %), about 6 to about 60 weight percent water (preferably about 20–40 weight %), and about 20 to about 65 weight percent polymer latex (preferably about 25–50 weight %).

U.S. Pat. No. 5,385,785 to Walter C. Lovell, a named inventor herein, previously incorporated by reference, discloses a high-temperature conductive-resistant coating composition suitable for use as coating 114. The coating includes a substantially non-continuous electrically conductive component suspended in a substantially non-conductive binder such as an alkali-silicate compound. The electrically conductive component can be included in an amount of about 4–15 weight percent and the binder can be included in an amount of about 50–68 weight percent. These components can be combined with about 2–46 weight percent water. Following deposition of the material, it is dried to provide the desired coating. The electrically conductive component is preferably graphite or tungsten carbide. The preferred binder includes an alkali-silicate compound containing sodium silicate, china clay, silica, carbon and/or iron oxide and water. It is to be understood that when weight percentages include water, the dried composition will have a different weight composition due to substantial evaporation of the water.

A graphite composite which has been found to be especially preferred for use as coating 114 of the present invention includes powdered graphite and an alkali silicate dispersed in a polymeric binder. Most preferably, the composite is a solid emulsion of graphite and china clay dispersed in polyvinyl acetate polymer. The composite can be deposited as a liquid coating composition, comprising from about 1 to about 30 weight percent graphite (preferably about 10 to about 30 weight percent for desirable resistivity values), about 20 to about 55 weight percent of an alcoholic carrier fluid, about 9 to about 48 weight percent of polyvinyl acetate emulsion, and about 4 to about 32 weight percent of china clay. The alcoholic carrier fluid comprises from about 0 to about 100 weight percent ethyl alcohol; with the remainder of the carrier fluid comprising water. A higher proportion of alcohol is selected for faster drying. Excessive graphite (beyond about 30 weight %) can cause undesirable coagulation, while excessive alcoholic carrier fluid (beyond about 55 weight % of the coating composition) can cause the mixture to separate.

One highly preferred exemplary composite is formed by preparing a mixture of 97.95 parts by weight water (33.42 weight %), 58.84 parts by weight ethyl alcohol (20.08 weight %), 48.30 parts by weight graphite (16.65 weight %), 52.38 parts by weight polyvinyl acetate emulsion (17.87 weight %), and 35.09 parts by weight china clay (11.97 weight %). This mixture is applied to a substrate and allowed to dry. Additional details regarding preferred components are discussed below in Example 1. It has been found that increasing the weight percentages of water and graphite decreases the resistivity, while decreasing the weight percentages of water and graphite increases the resistivity.

As discussed below in Example 1, the preferred polyvinyl acetate emulsion is known as a heater emulsion, and is available from Camger Chemical Company. This product includes polyvinyl acetate, silica, water, ethyl alcohol and toluene in an emulsion state. In forming the above-described slurry, suitable solvents other than ethyl alcohol can be employed. However, it has been found that isopropyl alcohol is relatively undesirable for use with the Camger heater emulsion, as it can cause the heater emulsion to separate. It is to be appreciated that upon drying, volatiles such as water, alcohol and toluene will substantially evaporate, thus resulting in different weight percentages of components in the dried coating.

Alternatively, substrate 78 and coating 114 may be part of a magnetic recording tape. U.S. Pat. Nos. 4,758,815; 4,823,106; and 5,180,900, all to Walter C. Lovell, a named inventor herein, the disclosures of which have been previously incorporated herein by reference, disclose techniques for constructing electrically resistive structures from magnetic recording tape. Such tapes are well known in the art, and are also discussed in 10 McGraw-Hill Encyclopedia of Science and Technology 295, 299–300 (6th Ed. 1987); basically, they consist of magnetic particles (such as gamma ferric oxide or chromium dioxide) dispersed in a binder and coated onto a base substrate such as a polyester film. Preferred tapes for use with the present invention include 3M #806/807 1" wide recording tape with carbon coating or 3M "Scotch Brand" (0227-003) 2" wide studio recording tape with carbon coating, both as provided by the Minnesota Mining and Manufacturing Company.

Figure 6B:
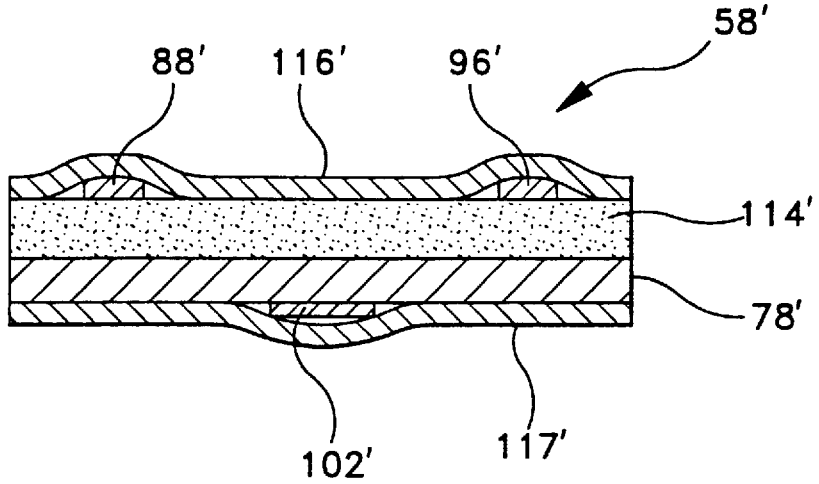
FIG. 6B is a view similar to FIG. 6A for an inductive structure employing a magnetic recording tape.

FIG. 6B shows a cross-section through a conductive-resistive medium and substrate assembly 58' formed with magnetic recording tape. Items similar to those in FIG. 6A have received a "prime." It will be seen that construction is similar to FIG. 6A, except that strips 88', 96' are located on top of coating 114', since coating 114' and substrate 78' are preformed as the magnetic recording tape. Strips 88', 96' may be copper strips having an electrically conductive adhesive on one side thereof, to ensure electrical contact with coating 114'. Suitable strips are available from McMaster-Carr Supply Co. of New Brunswick, N.J.

Figure 7:
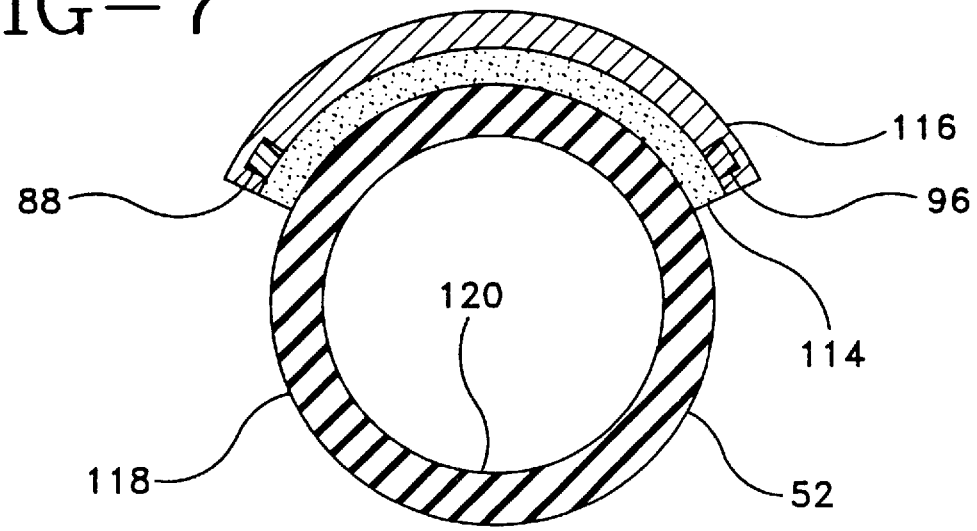
FIG. 7 shows a cross-section through a fluorescent bulb having an inductive structure mounted directly thereon.

It will be appreciated that conductive-resistive medium and substrate assembly 58 may take many forms. For example, in lieu of substrate 78, a surface of translucent housing 52 may be used as a substrate and conductive-resistive medium may be applied to at least a portion of the surface to form the conductive-resistive medium and substrate assembly, as shown in FIG. 7. It is envisioned that outside surface 118 of housing 52 would normally be the most convenient to which to apply the conductive-resistive material. However, it is to be appreciated that it would also be possible to apply the material to inside surface 120. Furthermore, it is to be appreciated that magnetic recording tape, when used in the inductive structure, could also be applied directly to either outside surface 118 or inside surface 120. Of course, application of materials to inside surface 120 of housing 52 would complicate fabrication of lightbulb 68 and therefore, as noted, outside surface 118 would normally be preferred.

It will be appreciated that inductive structures according to the invention, such as assembly 58, may be formed relatively thin and with relatively high surface area to achieve efficient heat dissipation.

Referring again to FIG. 4, conductive-resistive medium and substrate assembly 58 is preferably positioned within about 1 inch or less of outside (exterior) surface 118 of translucent housing 52. The significance of this spacing will be discussed further hereinbelow, as will an embodiment of the invention where the spacing can be increased to, e.g., 12 inches. Still referring to FIG. 4, it will be noted that housing 52 is preferably elongate, and conductive-resistive medium and substrate assembly 58 is preferably substantially coextensive with translucent housing 52. However, as discussed below, in other embodiments of the invention it is not necessary for the housing 52 and conductive-resistive medium and substrate assembly 58 to be coextensive.

Figure 1:
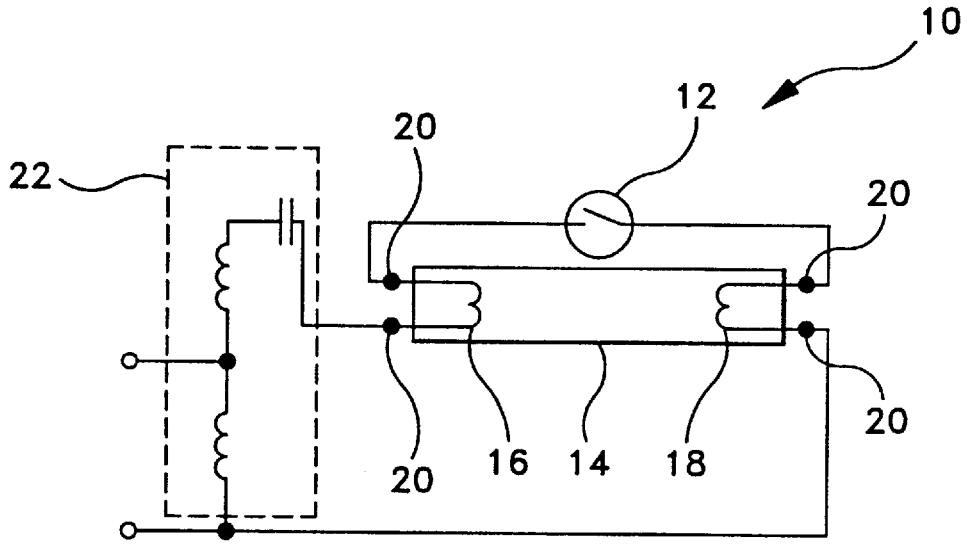
FIG-1 PRIOR ART
FIG. 1 is a schematic diagram of a preheat lamp circuit according to the prior art.
Figure 2:
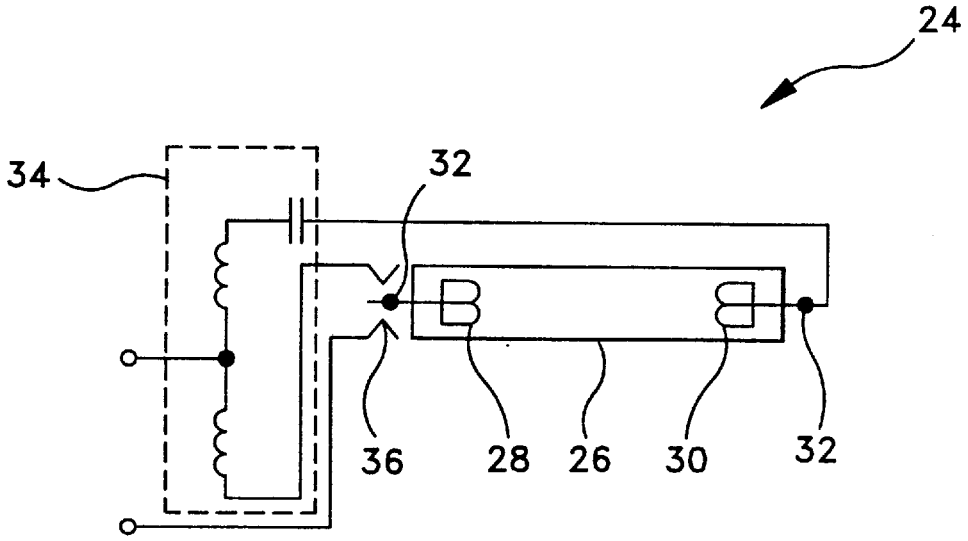
FIG-2 PRIOR ART
FIG. 2 is a schematic diagram of an instant-start lamp circuit according to the prior art.
Figure 3:
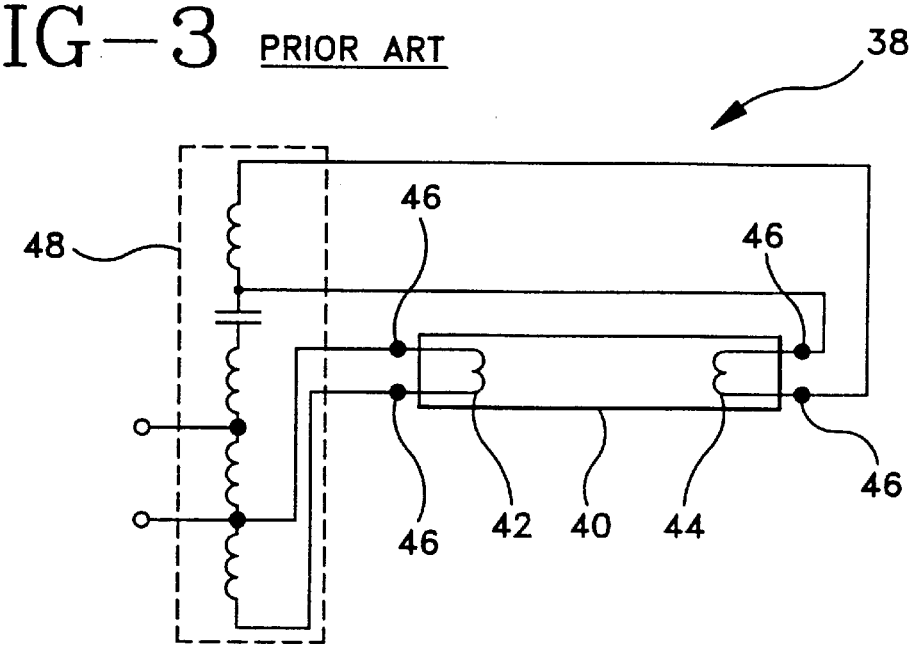
FIG-3 PRIOR ART
FIG. 3 is a schematic diagram of a rapid-start lamp circuit according to the prior art.
Figure 5:
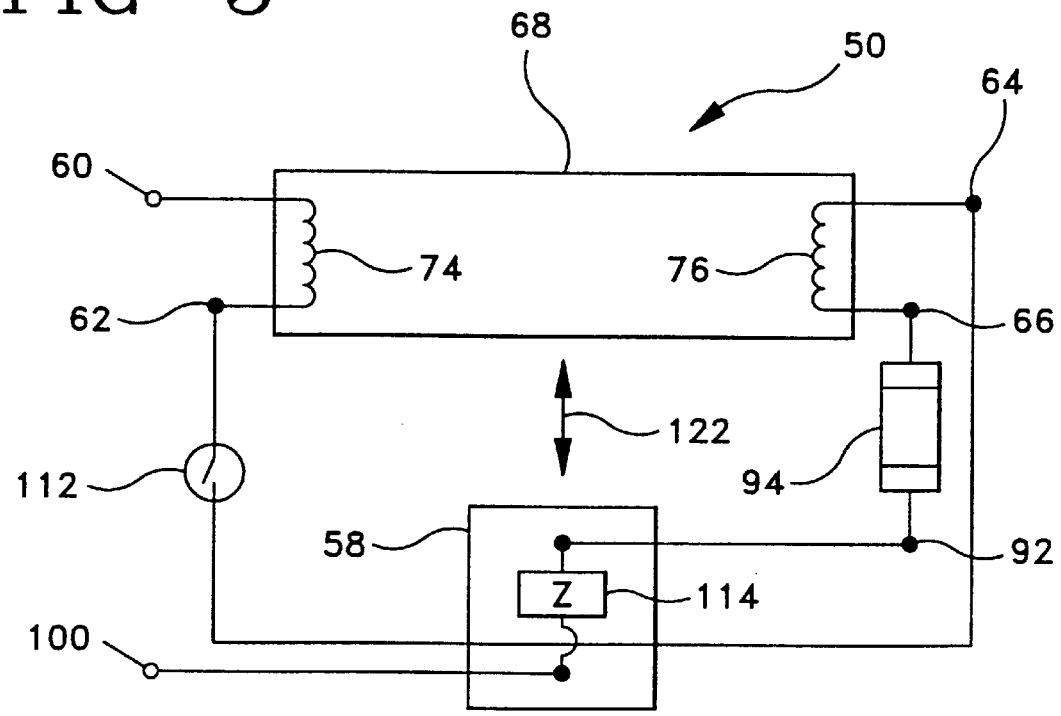
FIG. 5 is a circuit diagram of the apparatus of FIG. 4.

Referring now to FIG. 5, which is a circuit diagram of the embodiment shown in FIG. 4, operation of the first embodiment of the invention will now be described. An AC voltage, such as ordinary household voltage (i.e., 120 VAC, 60 Hz), is applied between first terminal 60 and sixth terminal 100. Upon initial application of the voltage, starter switch such as starter bulb 112 closes, allowing electrical current to pass through electrodes 74,76, causing them to heat and become susceptible to emission of electrons. At the same time, the electrical current passes through conductive-resistive coating 114 of conductive-resistive medium and substrate assembly 58. The coating 114 is shown in the circuit diagram of FIG. 5 as a generalized impedance Z.

It is believed that the passage of ordinary alternating current (such as 60 Hz household current) through the coating 114 results in an electromagnetic field interaction (symbolized by double headed arrow 122) between conductive-resistive medium and substrate assembly 58 and fluorescent lightbulb 68. In particular, it is believed that the electromagnetic field interaction influences at least one of the fluorescent medium 56 and the gaseous material (such as mercury) contained within housing 52. In other embodiments of the invention, discussed below, a direct current having a "pulsed" or "rippled" component is passed through a coating similar to coating 114. Such "pulsed" or "rippled" components have been found to yield a measured "frequency," with a frequency meter, on the order of 60–1000 Hz. Thus, it is believed that the electromagnetic field interaction is also a low-frequency phenomena, on the order of 0–1000 Hz, depending on the frequency input to the inductive structure.

As discussed further below in the examples section, bulb 68 will only start if conductive-resistive medium and substrate assembly 58 is maintained sufficiently proximate to housing 52, preferably within about 1 inch. (An alternative embodiment which permits increasing the distance to about 12" is discussed below). Thus, the present invention permits the starting of a fluorescent bulb without the use of a ballast. Once the electrodes 74,76 have become sufficiently hot, bulb 112 opens resulting in current flow between electrodes 74,76 and full illumination of lightbulb 68. Once lightbulb 68 is fully illuminated, conductive-resistive medium and substrate assembly 58 may be removed from the proximity of housing 52, and lightbulb 68 will remain illuminated.

In view of the foregoing description of the operation of the first embodiment of the invention, it will be appreciated that in a method according to the invention, electric current is passed through an inductive structure such as conductive-resistive medium and substrate assembly 58 adjacent a fluorescing medium, such as the fluorescent medium contained within lightbulb 68. Current is passed through assembly 58 in an amount sufficient to induce fluorescence in the presence of an electrical potential imposed on the fluorescing medium, in particular, between electrodes 74, 76. As discussed above, it will be appreciated that the method may also include the step of maintaining the conductive-resistive medium of assembly 58 within about one inch or less of the fluorescing medium contained within lightbulb 68. The inductive structure used in the method can be any of the structures discussed herein, including the solid emulsion materials (such as the graphite composite) and the magnetic recording tape materials.

It has been found that conductive-resistive medium and substrate assemblies 58 for use with the present invention are best specified by their resistance, in ohms, at DC. For a given composition of conductive-resistive coating 114, a given length of opposed conductor strips 88,96, and a given distance between the conductor strips, the DC resistance will be set by the thickness of conductive-resistive coating 114. The required thickness of coating can be determined by solving the following equation:

$$R=\rho d_s/(L_s t)$$

where:

R=desired D.C. resistance, Ω p=resistivity of coating material being used, Ω-inches $d_s$=distance between conductor strips, inches $L_s$=length of conductor strips, inches t=required thickness of coating, inches.

The resistivity value ρ should be determined for each batch of coating 114 by measuring R for a coating of known dimensions; for the preferred composition used in Example 2, the value of ρ is about 16.5 Ω-inches (0.419 Ω-m).

The appropriate DC resistance value for conductive-resistive medium and substrate assemblies 58 for use with a given fluorescent lightbulb is generally that which will result in the same voltage drop across the bulb in steady state operation with the assembly 58 as with a conventional ballast. It is determined by a process of trial and error. However, an initial approximation can be made as follows. First, operate the bulb with a conventional ballast and measure the RMS voltage drop across the bulb and the RMS current through the bulb (during steady-state operation). Next, calculate a "resistance" value for the bulb, R=V/I, where R="resistance" in ohms, V=voltage drop across bulb in volts, and I=current through bulb in amperes. It is to be understood that, as is well known in the art, fluorescent bulbs have highly nonlinear voltampere characteristics; the calculated "resistance" value is for approximation purposes only.

The DC resistance value for the conductive-resistive medium and substrate assembly should then be selected so as to achieve the same voltage drop across the bulb as for operation with the ballast. This can be done by applying the well-known voltage divider law to the series combination of the conductive-resistive medium and substrate assembly and the fluorescent lightbulb, using the bulb "resistance" calculated above and the applied (e.g., line) voltage, to solve for the required nominal resistance of the assembly 58 [hereinafter, "calculated nominal R"]. It is to be understood that, although the conductive-resistive medium and substrate assemblies 58 are specified by their DC resistance, they are not necessarily believed to be purely resistive; indeed, it is believed that they may exhibit both resistive and reactive (i.e., inductive or capacitive) components of impedance at typical alternating current (AC) frequencies. However, the preceding procedure has been found adequate for initial sizing of assemblies 58. Further, it is believed that the current passing through assemblies 58 is, at least substantially, an ordinary conduction current.

Figure 23:
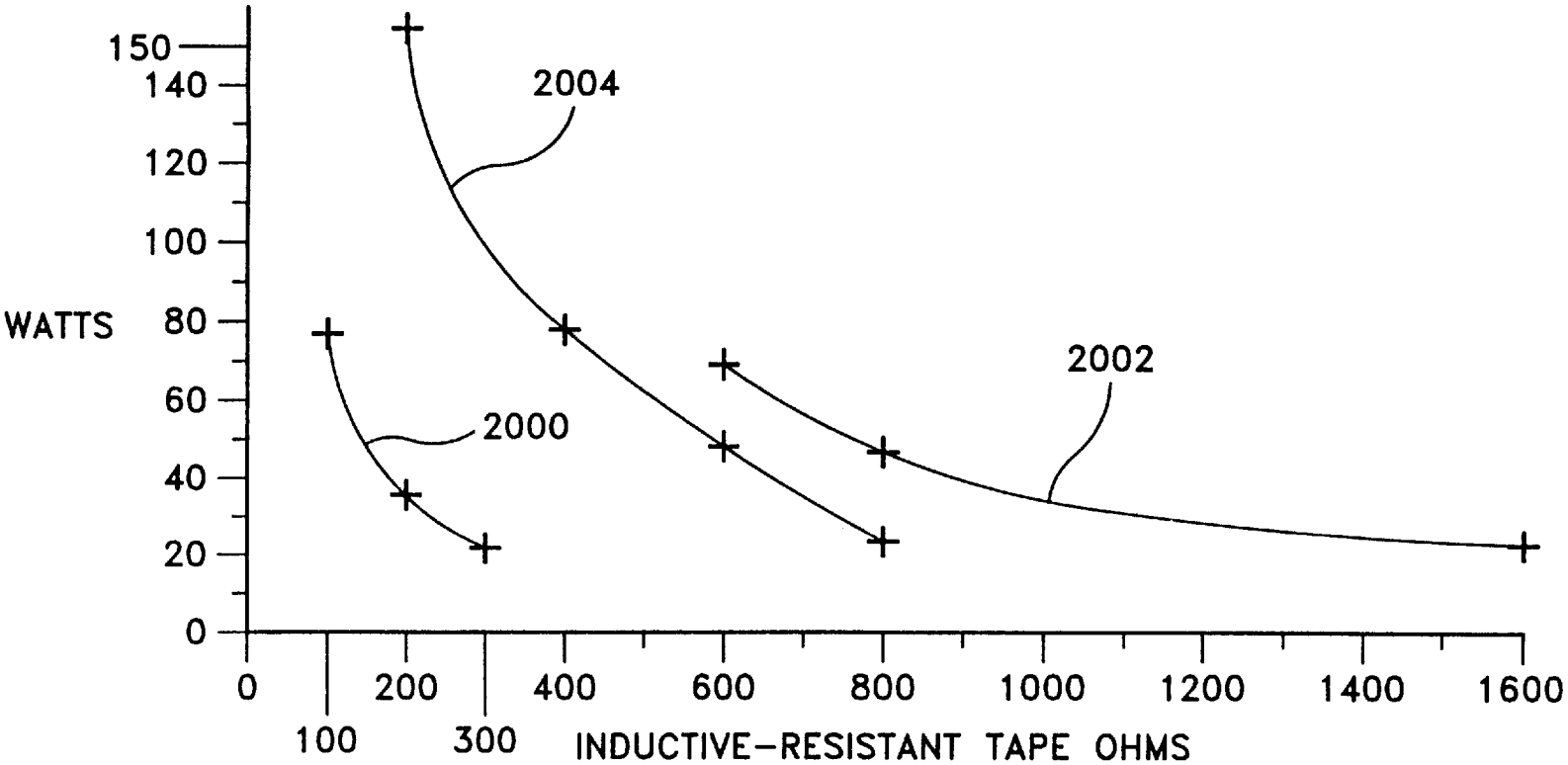
FIG. 23 is a plot of nominal wattage versus inductive structure nominal resistance for several preheat type bulbs.
Figure 24:
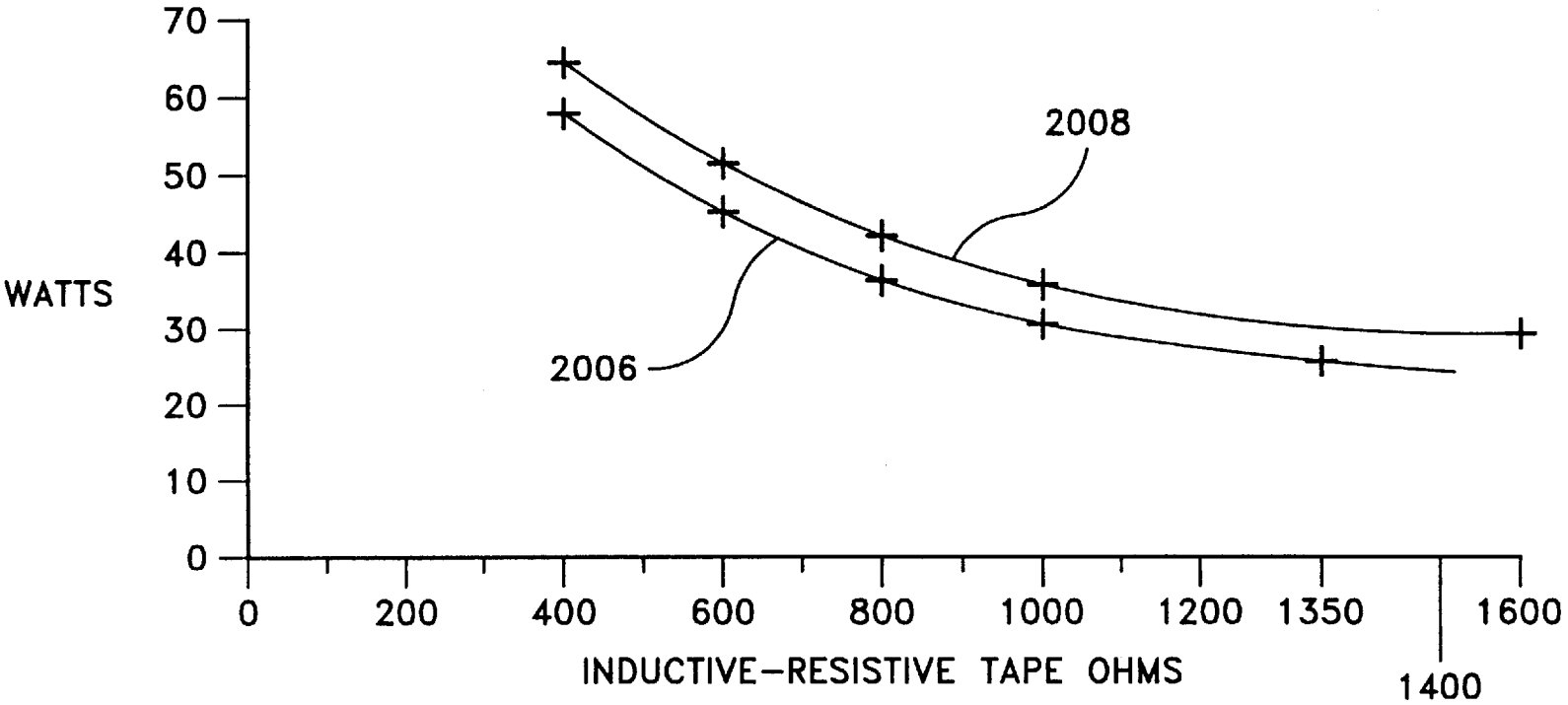
FIG. 24 is a plot similar to FIG. 23 for several instant-start type bulbs.

FIG. 23 shows plots of nominal wattage versus resistance value (nominal R) for various preheat type bulbs. Curve 2000 is for a 24 inch bulb operated on 114 VAC (line voltage across inductive structure and bulb); curve 2002 is for a 24 inch bulb operated on 230 VAC; and curve 2004 is for a 48 inch bulb operated on 230 VAC. The nominal wattage is the RMS line voltage times the line current drawn (also RMS), uncorrected for power factor. FIG. 24 is a similar plot for instant-start bulbs operating off a capacitor tripler circuit producing pulsed D.C. varying from 109 to 320 Volts, with 115 VAC, 60 Hz line input. Curve 2006 is for a 72 inch bulb and curve 2008 is for a 24 inch bulb. FIGS. 23 and 24 illustrate the nonlinearity of the resistance-selecting process.

It is known in the art that ballasts are generally incapable of operating at low temperatures. For example, standard ballasts typically cannot operate below 50°–60° F.; operation down to 0° F. is possible only with specialized, expensive, high power units. The present invention is capable of providing low-temperature operation (down to freezing temperatures). Such operation can be aided by using heating properties of the conductive-resistive medium employed with the present invention. Referring again to FIG. 4, coating 114 also generates ohmic heat in response to the passage of electrical current therethrough. Conductive-resistive medium and substrate assembly 58 can be disposed in thermal communication with housing 52 in order to transmit at least a portion of the heat to housing 52, thus further aiding low-ambient-temperature operation. This effect can be still further enhanced by mounting the conductive-resistive medium 114 directly on housing 52, as shown, for example, in FIG. 7.

Figure 8:
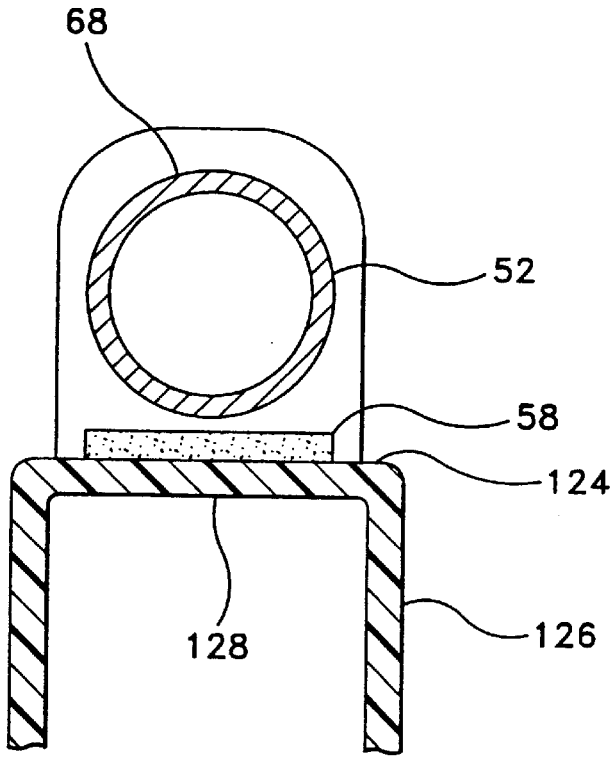
FIG. 8 shows one configuration in which an inductive structure of the present invention can be mounted on a conventional fluorescent light fixture.
Figure 9:
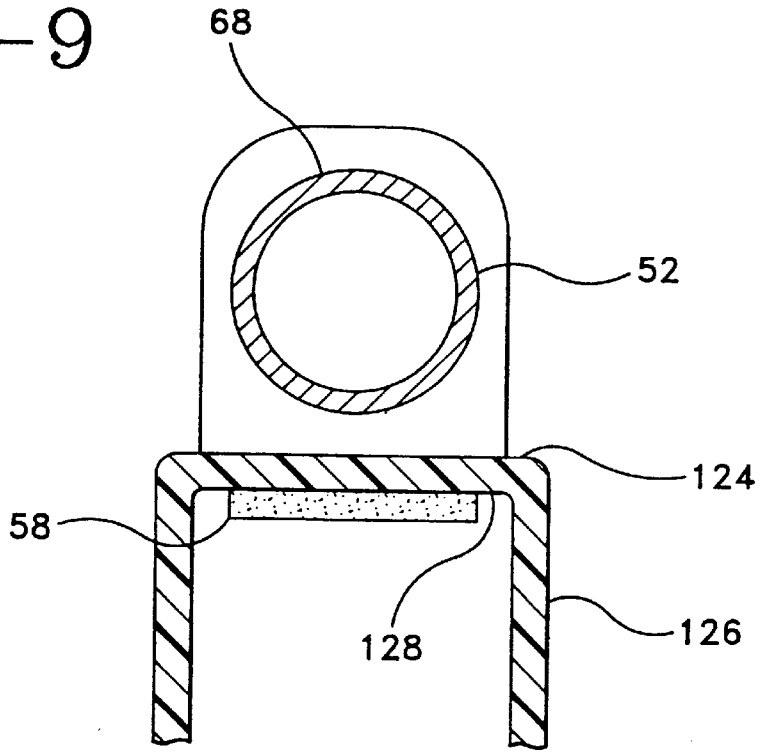
FIG. 9 shows another configuration in which an inductive structure of the present invention can be mounted on a conventional fluorescent light fixture.

As discussed below in the examples section (Examples 2, 3 and 12), the present invention has been employed with conventional fluorescent light mounting structures, which are typically made of sheet metal. FIG. 8 shows a typical cross section through such an installation wherein the conductive-resistive medium and substrate assembly 58 is applied to the top 124 of housing assembly 126. In an alternative configuration, conductive-resistive medium and substrate assembly 58 may be applied to the bottom 128 of housing 126, as shown in FIG. 9. It has been found that adhering the conductive-resistive medium and substrate assembly 58 to the metallic housing 126 apparently enhances the electromagnetic interaction between the conductive-resistive medium and substrate assembly 58 and the bulb 68, thus permitting the bulb to start when located further away from the conductive-resistive medium and substrate assembly 58. This effect may be thought of as a "focusing" of the electromagnetic field.

Figure 10:
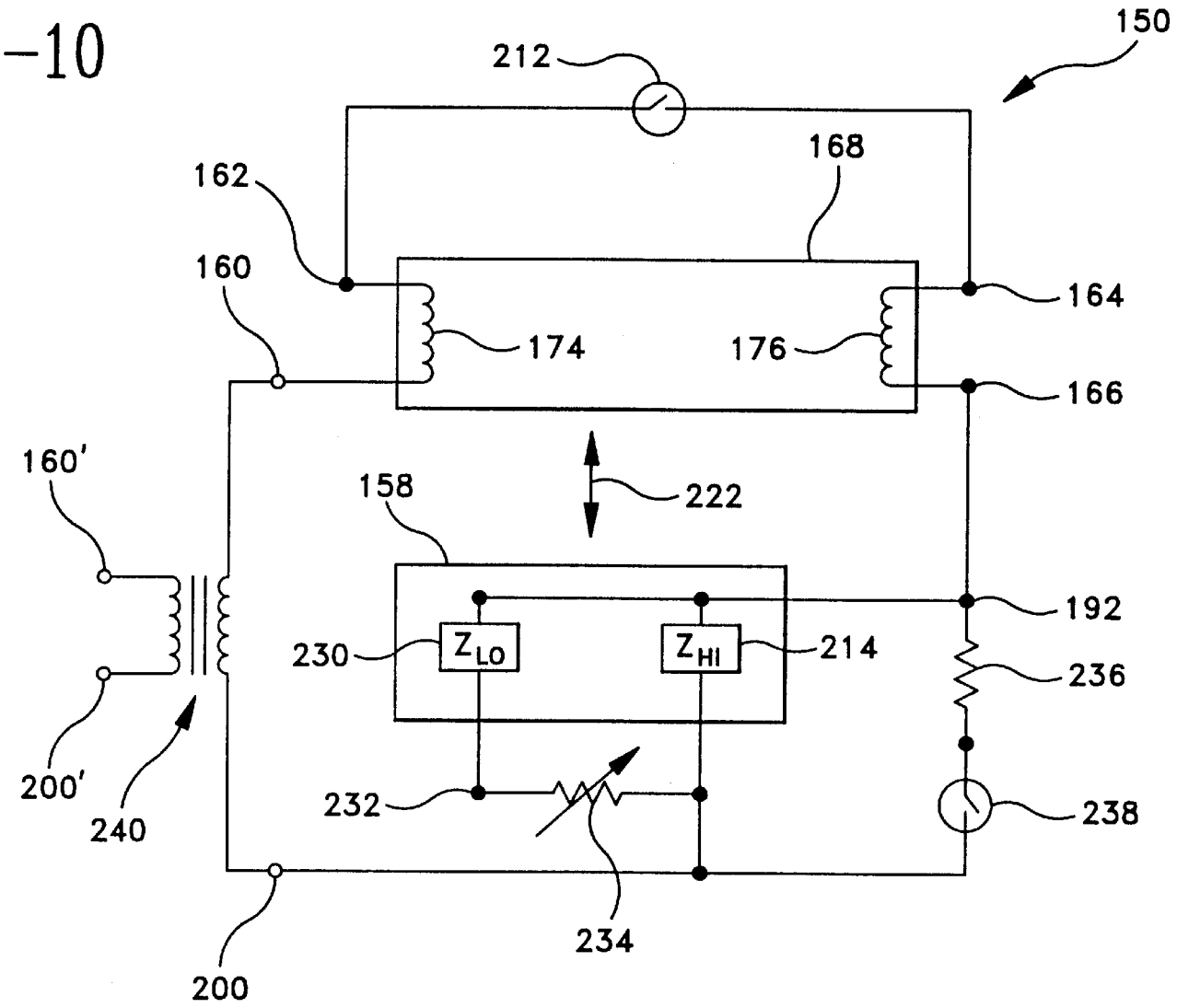
FIG. 10 shows a circuit diagram of an embodiment of the present invention adapted for dimming.

The present invention may also be employed to permit dimming of fluorescent lamps, using only a conventional incandescent lamp type dimmer such as a rheostat. FIG. 10 shows a circuit diagram for an embodiment of the invention which includes such a dimming function. Items similar to those shown in FIG. 5 have received the same reference numeral, incremented by 100. The inductive structure of the embodiment of FIG. 10 is formed as a conductive-resistive medium and substrate assembly 158. Assembly 158 includes first and second elongate tape structures generally similar to the elongate tape structure shown in FIGS. 4 and 6. One or both of these can be applied to a surface of lightbulb 168, as shown in FIG. 7. The second elongate tape structure includes a second substrate generally similar to substrate 78 of FIGS. 4 and 6, and having top and bottom edges similar to edges 80,82 of substrate 78. The second elongate tape structure also includes a second top conductor strip similar to top conductor strip 88 of assembly 58. The second top conductor strip has a first exposed end which is electrically interconnected with fifth electrical terminal 192. Assembly 158 also includes a second bottom conductor strip similar to bottom conductor strip 96 of assembly 58. The second bottom conductor strip has a first exposed end forming a seventh electrical terminal 232 as shown in FIG. 10.

A second conductive-resistive coating 230 is located on the second substrate and is electrically interconnected between the second top and second bottom conductor strips. The first conductive-resistive coating 214 and the second conductive-resistive coating 230 are both represented in FIG. 10 as generalized impedances, $Z_{HI}$ and $Z_{LO}$ respectively. The first and second conductive-resistive coatings 214,230 are selected for effective dimming of lightbulb 168, as described below. A conventional incandescent light dimmer 234 is electrically interconnected between sixth electrical terminal 200 and seventh electrical terminal 232. As discussed below in the examples section, first conductive-resistive coating 214 may be selected to yield a DC resistance of 1000 ohms, while second conductive-resistive coating 230 may be selected to yield a DC resistance of 200 ohms. Optionally, resistor 236 and a second starter switch such as second starter bulb 238 may be connected in series between fifth terminal 192 and sixth terminal 200, for reasons to be discussed hereinbelow.

Selection of first and second conductive-resistive coatings for effective dimming preferably proceeds as follows. The minimum impedance value Z of the assembly ("assembly Z") formed by: series connection of coating 230 and dimmer 234 in parallel with coating 214 should be roughly equal to the calculated nominal R for the bulb, discussed above. However, a somewhat lower value can be selected to aid in starting.

The maximum impedance value of the assembly should be selected to dim the bulb 168 down to the desired level; a ratio of maximum to minimum impedance as high as 26:1 has been tested in another dimming embodiment of the invention depicted in FIG. 13 and discussed below and in Example 5. It is believed that even higher ratios may be usable. Conversely, any ratio beyond 1:1 should yield some dimming; in practice, dimming has been observed at a ratio as low as 2:1 in the embodiment of FIG. 16 discussed below and in Example 7. The foregoing discussion applies to all dimming embodiments discussed herein; the "assembly Z" is simply the effective impedance of the inductive structure (s) in series with the bulb.

In operation, an AC voltage is applied between first and sixth terminals 160,200. Where desired, a step up transformer 240 may be employed to raise the voltage. In this case, line voltage is supplied to terminals 160', 200' and stepped up before being applied to first and sixth terminals 160,200. A stepped-up voltage will normally be employed for 48 inch (and other longer) bulbs. Starter bulb 212 operates conventionally and permits preheating of electrodes 174,176. An electromagnetic field interaction symbolized by arrow 222 is believed to be present between bulb 168 and conductive-resistive medium and substrate assembly 158. Once the bulb has started, and it is desired to dim the bulb, the resistance of dimmer 234 can be progressively increased, thereby increasing the overall impedance between terminals 160,200 and reducing the overall current flow. Accordingly, the lower current draw through the bulb 168 results in less of a voltage drop across bulb 168. The lower current results in dimming of bulb 168.

In order to achieve starting of bulb 168, dimmer 234 must normally be initially in or near a full bright position (i.e., minimum resistance value). Resistor 236 and a second starter switch such as second starter bulb 238 are optionally provided to permit starting with dimmer 234 in a dim position. When dimmer 234 is in dim position, i.e., at a relatively high resistance not near the minimum resistance value, the total impedance of assembly 158 and dimmer 234 might be too great to permit sufficient current to flow to warm electrodes 174,176. Accordingly, the second starter switch such as second starter bulb 238 in series with a resistor 236 may be connected in parallel with the unit which includes assembly 158 and dimmer 234. For initial starting, bulb 238 closes and provides a parallel current path through resistor 236, in order to insure adequate current flow to permit heating of electrodes 174,176. A suitable resistor value for use with a 48 inch 40 watt bulb is about 100 ohms. Once electrodes 174,176 are sufficiently hot, bulbs 212,238 open and bulb 168 can start at a relatively low light level.

Figure 11:
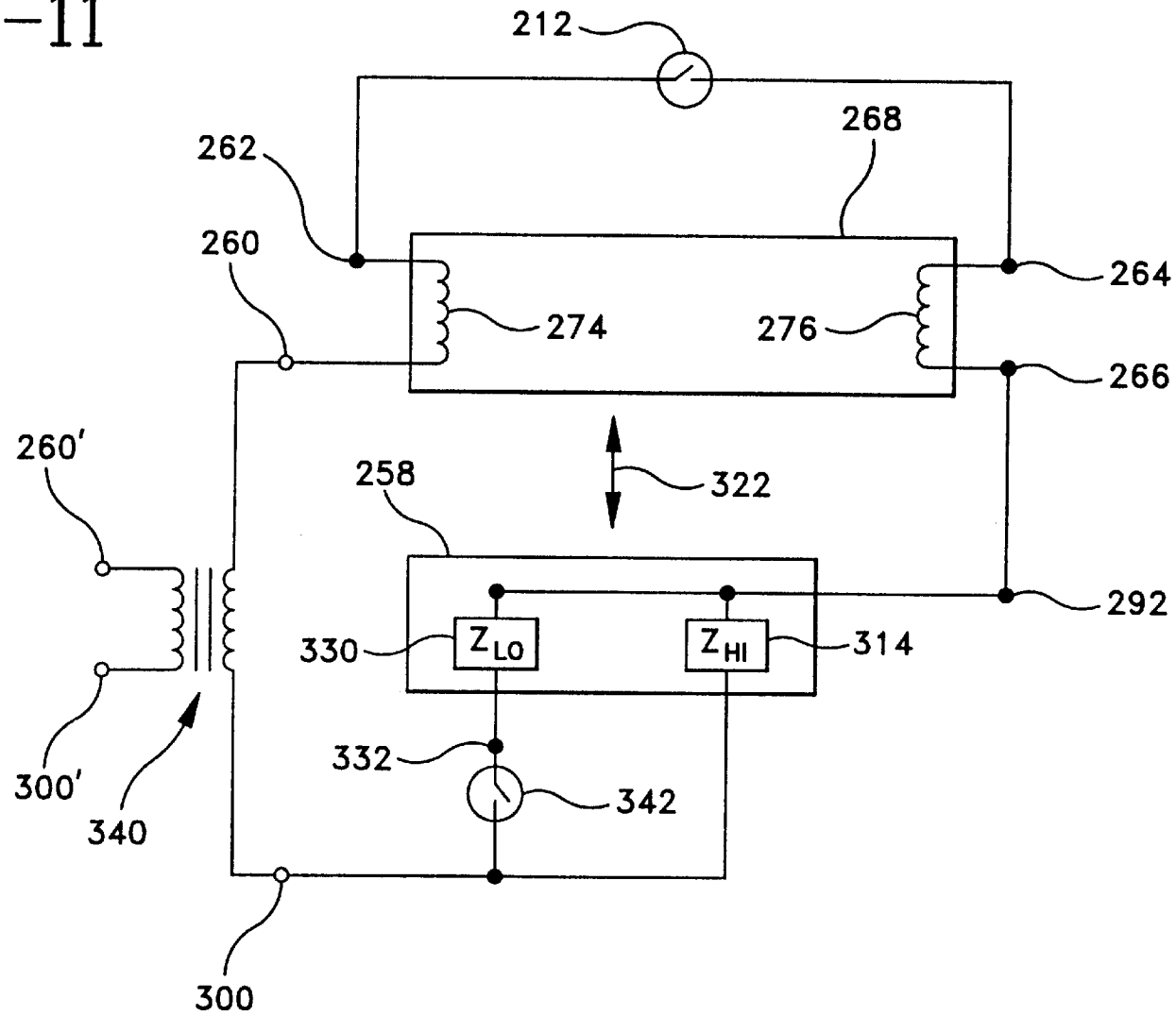
FIG. 11 shows a circuit diagram of an embodiment of the invention including two inductive structures selected for optimal starting and efficient steady-state operation.

FIG. 11 shows another alternative embodiment of the invention which is also provided with two elongate tape structures. One is selected for ease in starting the lightbulb, while the other is selected for efficient steady-state operation of the lightbulb. As used herein, "steady-state" refers to operation of the fluorescent lightbulb after the initial starting period. Components in FIG. 11 which are similar to those in FIG. 10 have received the same reference numeral, incremented by 100. Once again, the inductive structure of the embodiment of FIG. 11 includes a conductive-resistive medium and substrate assembly 258 which is formed with a second elongate tape structure including a second conductive-resistive coating 330. The second elongate tape structure includes a second substrate generally similar to substrate 78 of FIG. 4, and having top and bottom edges generally similarly to edges 80,82 of FIG. 4. A second top conductor strip generally similar to top conductor strip 88 as shown in FIG. 4 has a first exposed end, generally similar to first exposed end 90 of FIG. 4, which is electrically interconnected with fifth electrical terminal 292. Similarly, a second bottom conductor strip generally similar to bottom conductor strip 96 shown in FIG. 4 is secured to the second substrate adjacent the bottom edge and has a first exposed end forming a seventh electrical terminal 332.

A second conductive-resistive coating 330 is located on the second substrate and is electrically interconnected with the second top and second bottom conductor strips. The first conductive-resistive coating 314 is selected for efficient steady-state operation of the lightbulb. Resistance values of coatings 314, 330 can be selected in the same manner as set forth above for dimming purposes; the combined impedance of coatings 314, 330 (assembly Z) can be selected to be somewhat less than the calculated nominal R, for ease in starting. A second starter switch such as second starter bulb 342 is electrically interconnected between seventh electrical terminal 332 and sixth electrical terminal 300. (Note that the second starter switch (second starter bulb 342) of FIG. 11 is positioned differently than second starter bulb 238 of FIG. 10, and so has received an alternative reference numeral.)

Second starter switch such as second starter bulb 342 closes upon initial starting of the system to permit both low-impedance conductive-resistive coating 330 and high-impedance conductive-resistive coating 314 to conduct. This yields a relatively low equivalent resistance ($Z_{HI}$ in parallel with $Z_{LO}$) which permits more current to pass through electrodes 274, 276 to allow preheating of the electrodes. Once fluorescent bulb 268 has started, switch 342 opens, removing the low impedance conductive-resistive coating 330 from the circuit, thus permitting coating 314 to control effective impedance of the circuit, therefore resulting in more efficient operation. It is to be understood that bulb 342 could be located at the opposite terminal of item 330. Coating 314 might be selected to yield a DC resistance of, for example, 1000 ohms, while coating 330 might be selected to yield a DC resistance of, for example, 400 ohms.

Figure 12:
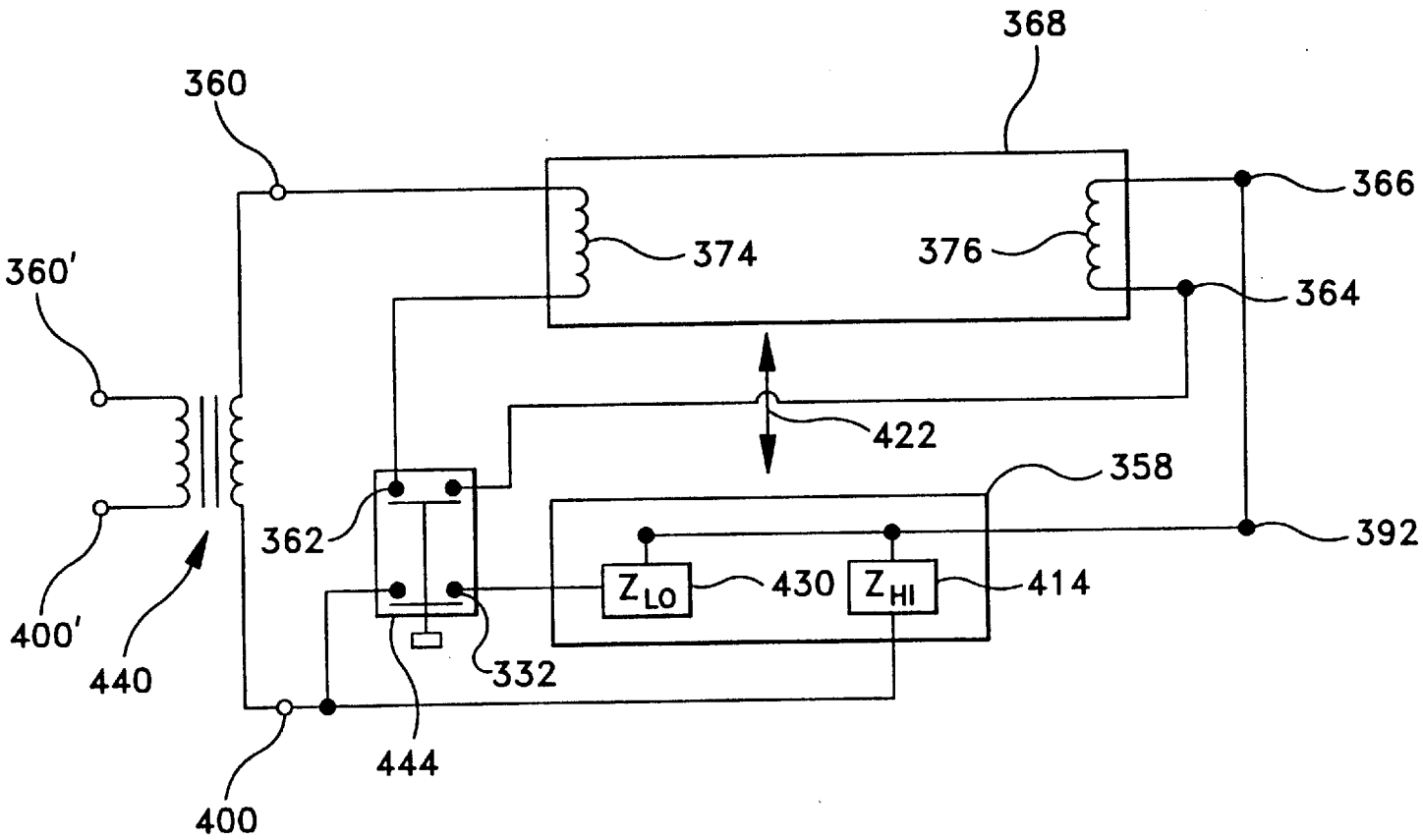
FIG. 12 shows a circuit diagram of an embodiment of the invention which is very similar to that shown in FIG. 11 and which is adapted for push-button operation.

Yet another alternative embodiment of the invention is shown in FIG. 12. This embodiment is quite similar to that of FIG. 11, and once again, similar components have received similar reference numerals incremented by 100. In the embodiment of FIG. 12, starter bulbs 212, 342 are replaced with a single switch such as push button type single throw double pole ("push-to-hold") switch 444. Switch 444 provides simultaneous, selective electrical interconnection between second electrical terminal 362 and third electrical terminal 364, and between seventh electrical terminal 332 and sixth electrical terminal 400. Second conductive-resistive coating 430 is selected for starting purposes similar to coating 330, and is removed from the circuit once push button switch 444 is opened, thus permitting efficient operation using only first conductive-resistive coating 414.

Figure 13:
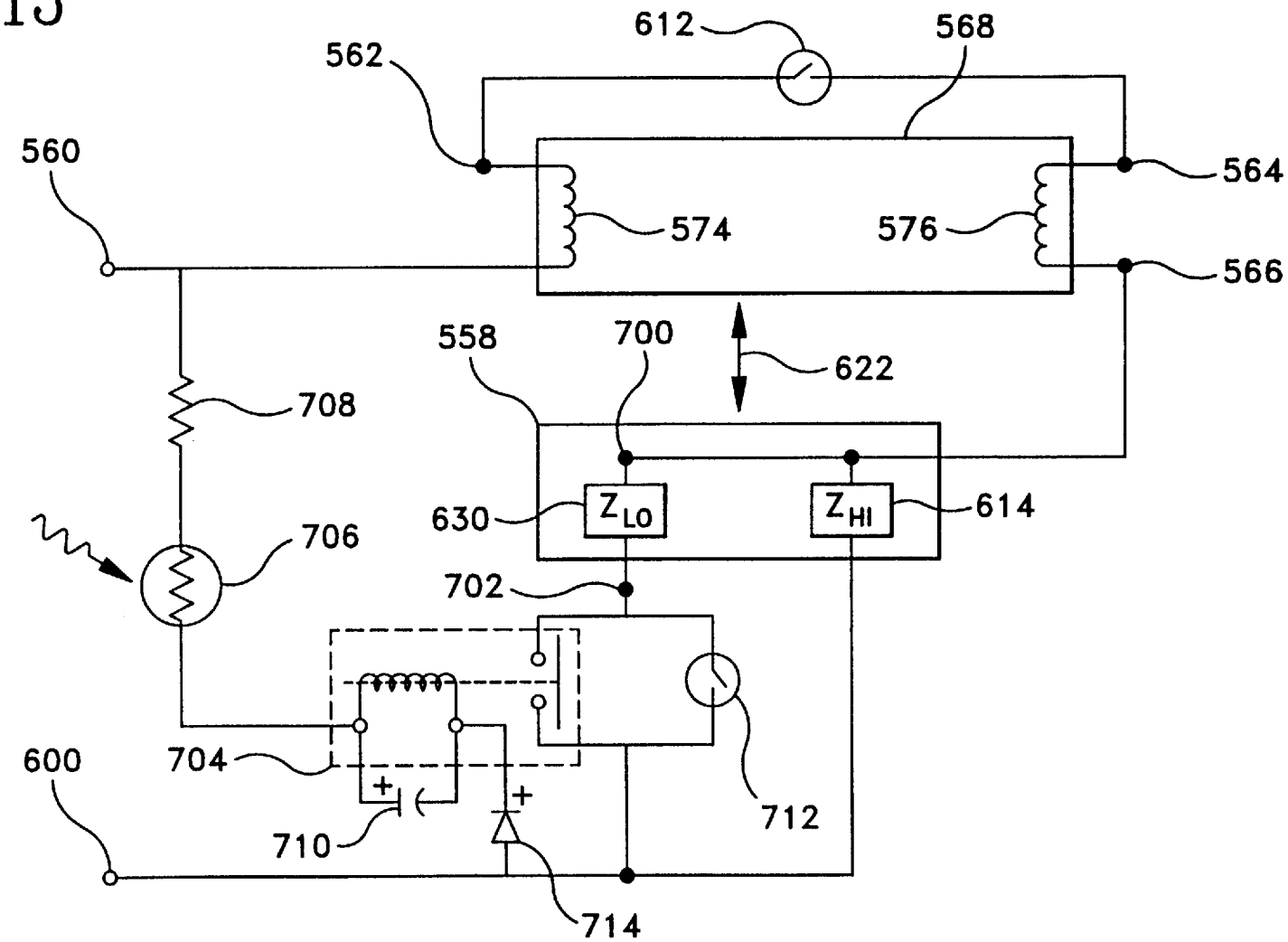
FIG. 13 is a circuit diagram of an embodiment of the invention adapted for automatic dimming.

Still another alternative embodiment of the invention is shown in FIG. 13. This embodiment is quite similar to that shown in FIG. 10. Similar components have received similar reference numerals incremented by 400. The embodiment shown in FIG. 13 is capable of automatic dimming in response to ambient light levels. Note that in FIG. 10, second conductive-resistive coating 230 is connected to sixth electrical terminal 200 through dimmer 234. In the embodiment of FIG. 13, second conductive-resistive coating 630 has seventh and eighth electrical terminals 700, 702. Coating 630 can be selectively connected into the circuit by means of an automatic circuit arrangement which will now be described.

Control relay 704 is capable of selectively connecting second conductive-resistive coating 630 into the circuit. The coil of relay 704 is connected across first and sixth electrical terminals 560, 600 in series with resistor 708, photoresistor 706, and diode 714. When the ambient surroundings are relatively light, photoresistor 706 conducts and energizes control relay 704. As shown in FIG. 13, when control relay 704 is in an energized state, it removes second conductive-resistive coating 630 from the circuit by opening the connection between terminals 702 and 600. This forces all the current in the circuit to pass through the first conductive-resistive coating 614, which is of a higher impedance, thus resulting in dim operation of lamp 568. When ambient surroundings are relatively dark, photoresistor 706 does not conduct, and thus the coil of control relay 704 is not energized. This results in closing the connection between terminals 702 and 600, and thus, second conductive-resistive coating 630 is placed in the circuit, in turn resulting in a relatively low impedance path for current flow, with bright operation of lamp 568. Diode 714 and polarized capacitor 710 insure that relay 704 does not chatter. Second conductive-resistive coating 630 is also placed in circuit for initial starting of bulb 568 by means of a second starter switch such as second starter bulb 712.

It will be appreciated that photoresistor 706 and control relay 704 together comprise a light-responsive switch for connecting the elongate tape structure which includes second conductive-resistive coating 630 in parallel with the first elongate tape structure which includes first conductive-resistive coating 614 by connecting seventh and eighth electrical terminals 700, 702 between fourth and sixth electrical terminals 566, 600. The first and second conductive-resistive coatings 614, 630 are selected for dim operation of bulb 568 when only first conductive-resistive coating 614 is in circuit, and for suitably bright operation of lightbulb 568 when both conductive-resistive coatings 614, 630 are in circuit.

Figure 14:
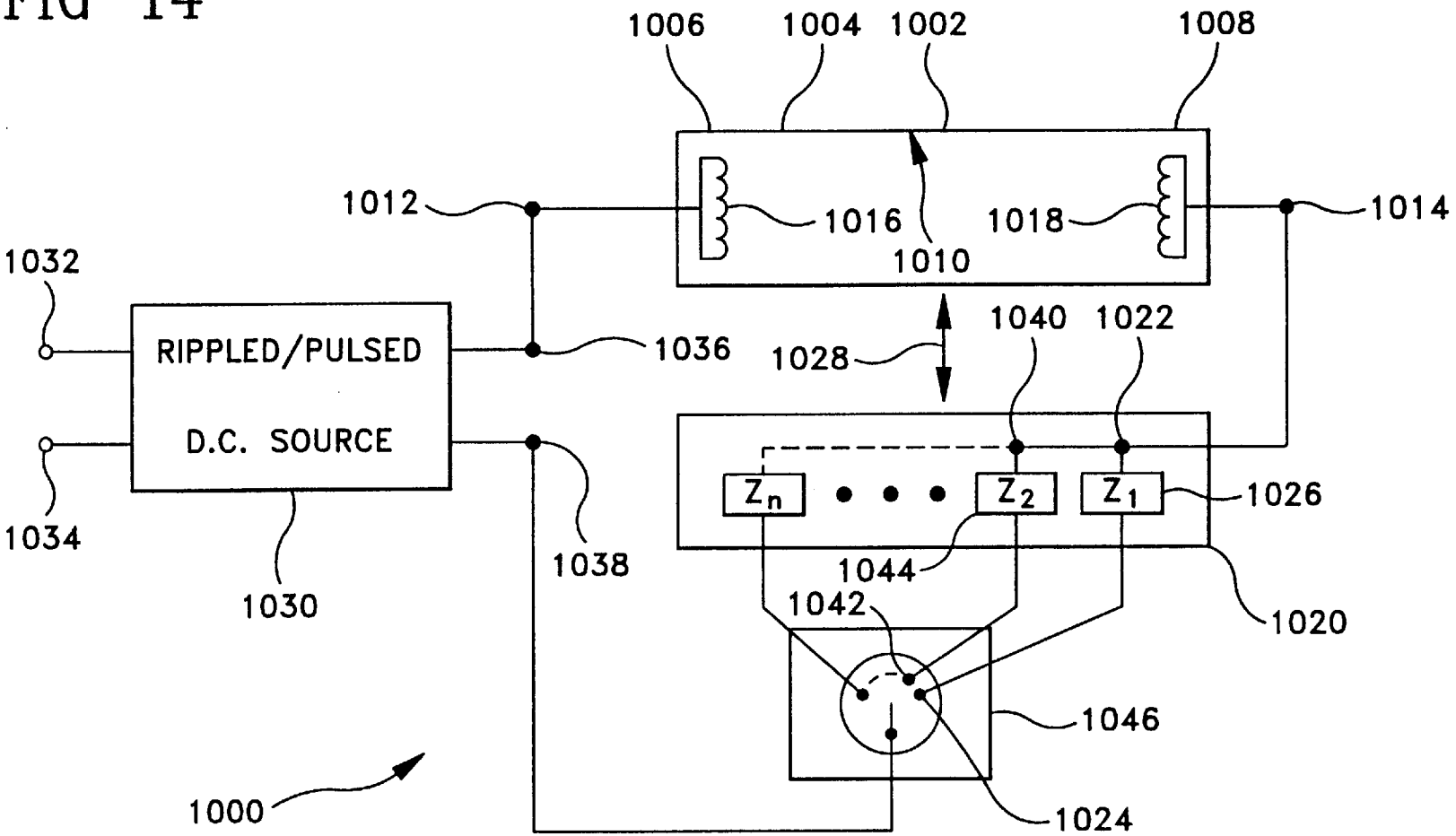
FIG. 14 is a circuit diagram of an embodiment of the invention adapted for "instant-start" operation and having dimming capability.

Referring now to FIG. 14, an "instant-start" embodiment of the invention 1000 is shown. Although referred to for convenience as an "instant-start" embodiment, the embodiment depicted in FIG. 14 and subsequent figures can, in fact, operate using either preheat or instant-start type bulbs, as discussed below. Still referring to FIG. 14, the apparatus of the embodiment 1000 includes a first fluorescent lightbulb 1002 including a translucent housing 1004 having first and second ends 1006, 1008 respectively. Bulb 1002 contains a fluorescent medium 1010 in the same fashion as discussed above with respect to other embodiments of the invention. Electrical connections, including first and second electrical terminals 1012, 1014 respectively, are provided on housing 1004. Bulb 1002 includes first and second electrodes 1016, 1018 located respectively at first and second ends 1006, 1008 of housing 1004.

Bulb 1002 may be of the instant-start type, having only a single contact at each end. Alternatively, bulb 1002 can be of the preheat type, having two contacts at each end, but only a single contact at each end need be connected. Bulb 1002 can even be a burned out preheat type bulb, with the connections at each end made to a remaining portion of the electrode, preferably the largest portion.

Still referring to FIG. 14, apparatus 1000 also includes an inductive structure 1020. Inductive structure 1020 includes at least a first elongate tape structure similar to those discussed above, including a first substrate having a top edge and a bottom edge; a first top conductor strip secured to the first substrate adjacent the top edge; and a first bottom conductor strip secured to the first substrate adjacent the bottom edge. The first top conductor strip has a first exposed end forming a third electrical terminal 1022 which is electrically interconnected with second electrical terminal 1014. The first bottom conductor strip has a first exposed end forming a fourth electrical terminal 1024. A first conductive-resistive coating 1026 is located on the first substrate and is electrically interconnected with the first top and first bottom conductor strips.

The construction of the first elongate tape structure is identical to that shown in the figures above for the preheat embodiment of the invention, and so has not been shown in detail in FIG. 14. Rather, third and fourth electrical terminals 1022, 1024 of first conductive-resistive coating 1026 have been shown in schematic form. First conductive-resistive coating 1026 has been labeled $Z_1$ to indicate its nature as a generalized impedance. Double headed arrow 1028 symbolizes the electromagnetic field interaction between inductive structure 1020 and bulb 1002. Apparatus 1000 also includes a source of rippled/pulsed D.C. 1030. This source may be a rectifier having first and second alternating current input terminals 1032, 1034. Source 1030 also has a first output terminal 1036 electrically interconnected with first electrical terminal 1012, and a second output terminal 1038 electrically connected with fourth electrical terminal 1024. Source 1030 is electrically configured to produce a direct current exhibiting a rippled/pulsed voltage component between output terminals 1036, 1038. Where source 1030 is a rectifier, alternating current, such as ordinary household current, may be applied to input terminals 1032, 1034 and may be rectified as well as stepped-up in voltage by source 1030. Source 1030 could also be a battery connected to a pulse-generating network electrically configured to step up the battery voltage, in which case A.C. input terminals 1032, 1034 would not be present.

Frequency values of the "ripple" on the D.C. have been measured from 60–120 Hz when a rectifier is used as source 1030 with 60 Hz input. In initial tests with a D.C. pulsing circuit, the "pulse-frequency" has been measured from 400–1000 Hz. It is not believed that there are any frequency limitations on the present invention, so that operation from, say, 1 Hz up to RF type frequencies should be possible. However, the measured values may be taken as an initial preferred range (60–1000 Hz). Ability to operate at low frequencies (much less than RF) is an advantage of the present invention.

Inductive structure 1020 may optionally include at least a second elongate tape structure configured as described above. The second elongate tape structure can have a top conductor strip with a first exposed end forming a fifth electrical terminal 1040. Similarly, the bottom conductor strip of the second elongate tape structure can include a first exposed end forming a sixth electrical terminal 1042. The second elongate tape structure can include a second conductive-resistive coating 1044 which is depicted in FIG. 14 as a generalized impedance $Z_2$. Any number of additional elongate tape structures (or equivalent) may be provided, as suggested in FIG. 14 by the depiction of generalized impedance $Z_n$. A switch 1046 can be provided to selectively electrically interconnect fifth and sixth electrical terminals 1040, 1042 between second electrical terminal 1014 and second output terminal 1038 of source 1030. FIG. 14 shows a configuration of switch 1046 wherein a single conductive-resistive coating (any one of $Z_1$–$Z_n$) can be selectively interconnected between second terminal 1014 and second rectifier output terminal 1038.

Figure 15:
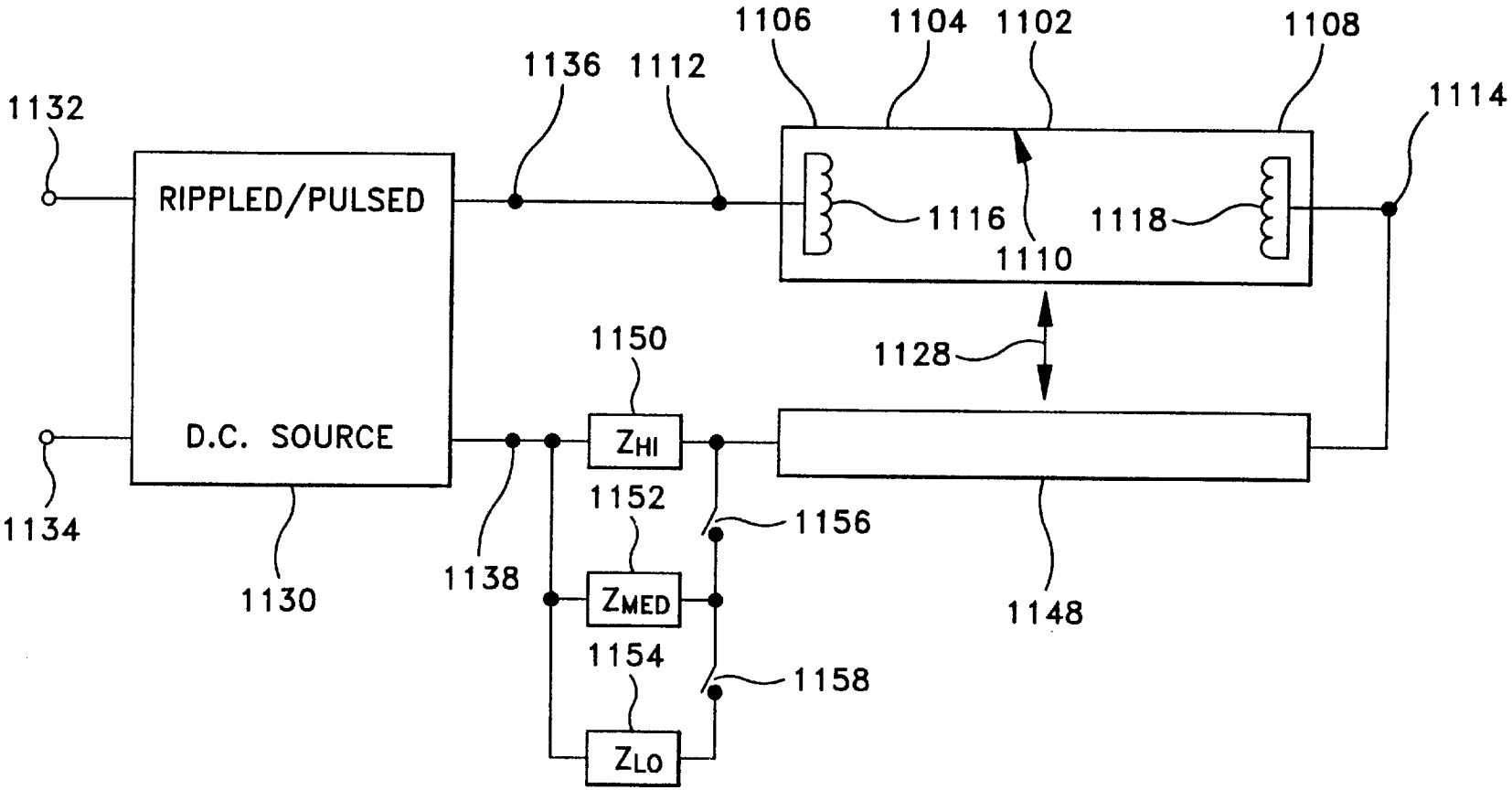
FIG. 15 is a circuit diagram similar to FIG. 14 but with a slightly modified dimming structure.

FIG. 15 shows an embodiment of the invention very similar to that shown in FIG. 14, but having an alternative switching structure for the generalized impedances representing the conductive-resistive coatings. Items in FIG. 15 similar to those in FIG. 14 have received the same reference numeral, incremented by 100. A primary inductive structure 1148 is provided in proximity to first fluorescent lightbulb 1102 to provide electromagnetic field interaction symbolized by arrow 1128 for purposes of starting bulb 1102. Generalized impedances representing additional conductive-resistive coatings 1150, 1152 and 1154 and designated as $Z_{HI}$, $Z_{MED}$ and $Z_{LO}$ are provided for purposes of dimming. (It is to be understood that the multiple conductive-resistive coatings in FIG. 14 are also provided for dimming purposes).

Conductive-resistive coating 1150 represented by impedance $Z_{HI}$ is connected in series with primary inductive structure 1148, while switch 1156 permits conductive-resistive coating 1152 represented as $Z_{MED}$ to be selectively connected in parallel with $Z_{HI}$ 1150. When coating 1152 is connected in parallel with coating 1150, the combined impedance is less, resulting in greater current flow and higher voltage across bulb 1102. When $Z_{MED}$ is removed from the circuit, the bulb operates in a dimmer range. Similarly, switch 1158 permits coating 1154 represented as $Z_{LO}$ to be selectively connected in parallel with $Z_{HI}$ 1150 and $Z_{MED}$ 1152. $Z_{LO}$ may be selected to provide a relatively bright light when in parallel with $Z_{HI}$, and $Z_{MED}$; $Z_{MED}$ may be selected for a medium-intensity light when in parallel with $Z_{HI}$, and $Z_{HI}$ may be selected to produce a relatively dim light by itself. Two or all three of $Z_{HI}$, $Z_{MED}$ and $Z_{LO}$ could be of equal resistance since the parallel combinations will yield the desired overall resistance values. A two-level ring light (which could easily be expanded to three levels as in FIG. 15) is described below in Example 8.

Figure 16:
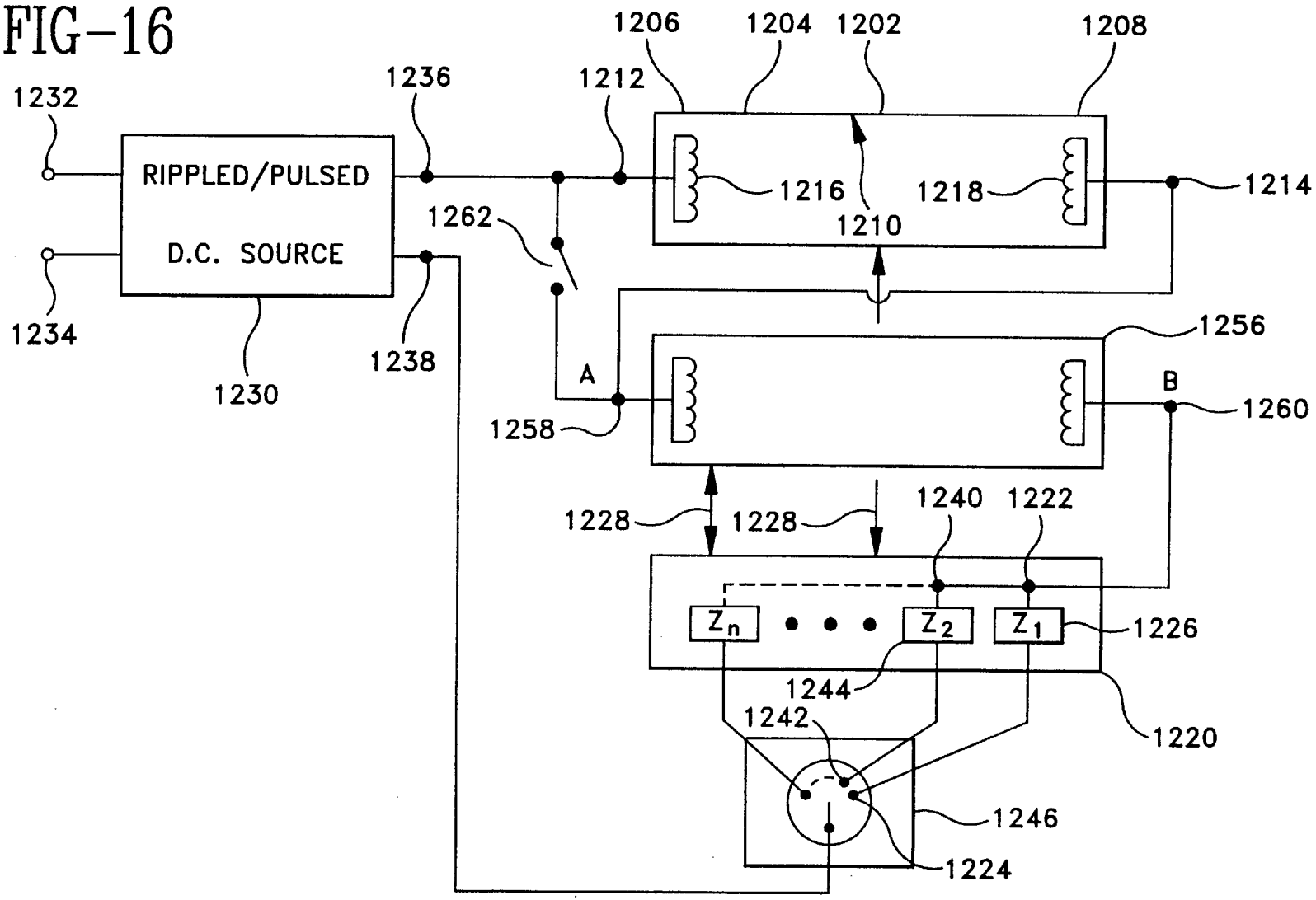
FIG. 16 is a circuit diagram of a two-bulb instant-start apparatus with dimming formed in accordance with the present invention.

FIG. 16 shows yet another embodiment of the invention of the "instant-start" type, employing a second fluorescent lightbulb. Components similar to those in FIG. 14 have received the same reference number, incremented by 200. Second fluorescent lightbulb 1256, which may also be either an instant-start or a preheat type, as discussed above, has an electrical terminal A numbered 1258 and electrical terminal B numbered 1260 at opposite ends. Second and third electrical terminals 1214, 1222 are electrically interconnected through second fluorescent lightbulb 1256 by having terminal A, numbered 1258, electrically interconnected with second electrical terminal 1214 and having terminal B, numbered 1260, electrically connected with third electrical terminal 1222. Switch 1262 provides selective electrical interconnection between first electrical terminal 1212 and terminal A, designated as 1258, in order to electrically remove first bulb 1202 from the circuit when it is not desired to illuminate that bulb, by providing a short circuit across bulb 1202.

Figure 17:
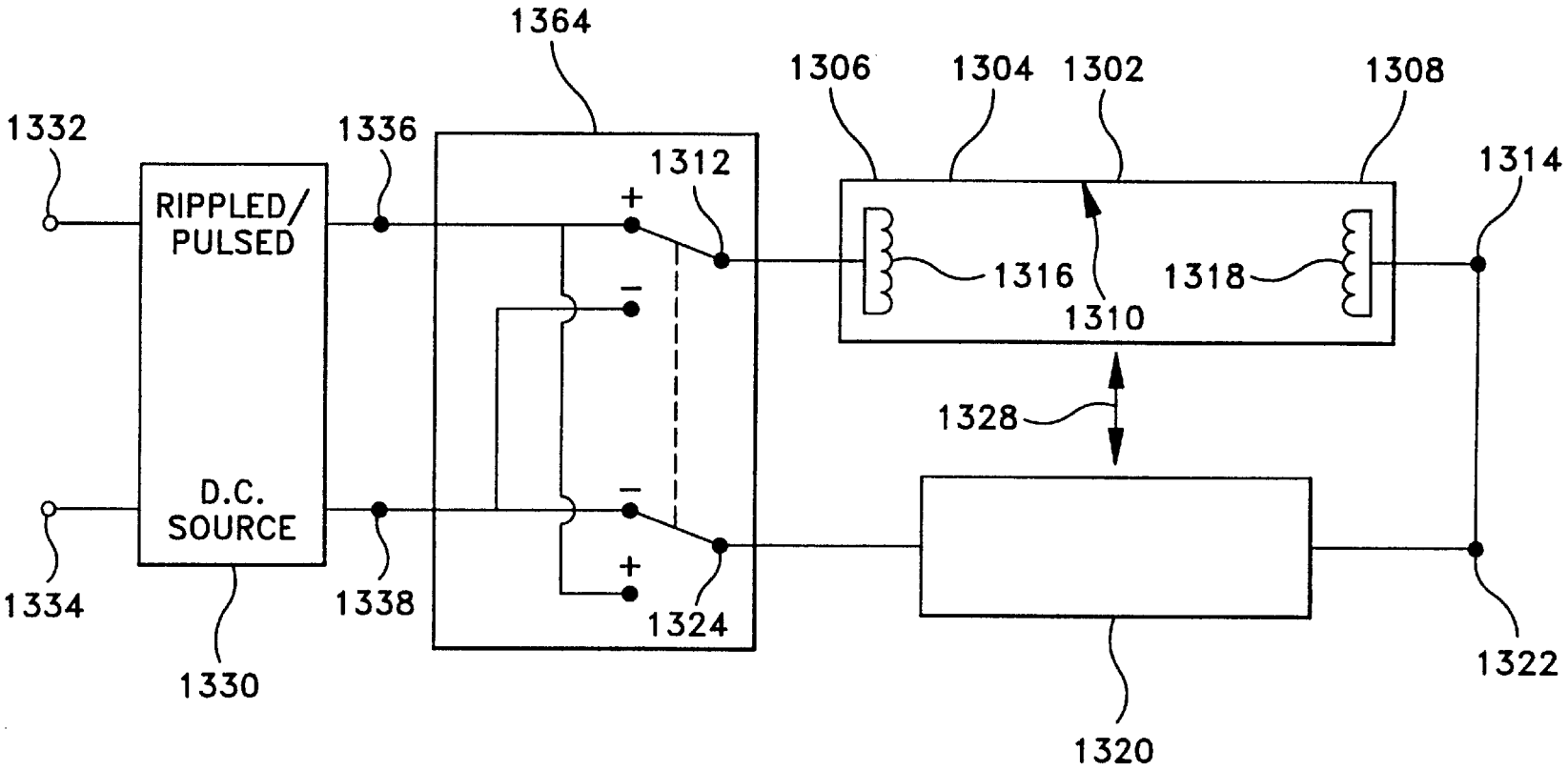
FIG. 17 is a circuit diagram of a special polarity-reversing "instant-start" embodiment formed in accordance with the present invention.

FIG. 17 shows yet another alternative instant-start embodiment, in this case adapted to permit starting of the bulb with the inductive structure located further away from the bulb, by means of a polarity-reversing switch. Items in FIG. 17 which are similar to those in FIG. 14 have received the same reference numeral, incremented by 300. In this configuration, an inductive structure 1320 is provided which may be of the same type of elongate tape structure design discussed above. A double pole single throw polarity reversing switch 1364 is configured to work in conjunction with source 1330 to apply a "voltage spike" to lightbulb 1302 for starting purposes. Switch 1364 has first and second positions. Rectifier 1330 has a positive output terminal 1336 and a negative output terminal 1338. In the first position of switch 1364, switch 1364 electrically connects positive terminal 1336 with first electrical terminal 1312 and negative terminal 1338 with fourth electrical terminal 1324 (as shown in FIG. 17). In the second position of switch 1364, switch 1364 electrically connects negative terminal 1338 with first electrical terminal 1312 and positive terminal 1336 with fourth electrical terminal 1324. It has been found that by applying a "jolt" with the polarity-reversing switch, it is possible to start bulb 1302 further away from inductive structure 1320 than would normally be possible, for example, about 4–6 inches away instead of about one inch. If the switch is not thrown, the inductive structure must be maintained within about one inch of bulb 1302 for starting purposes.

Figure 18A:
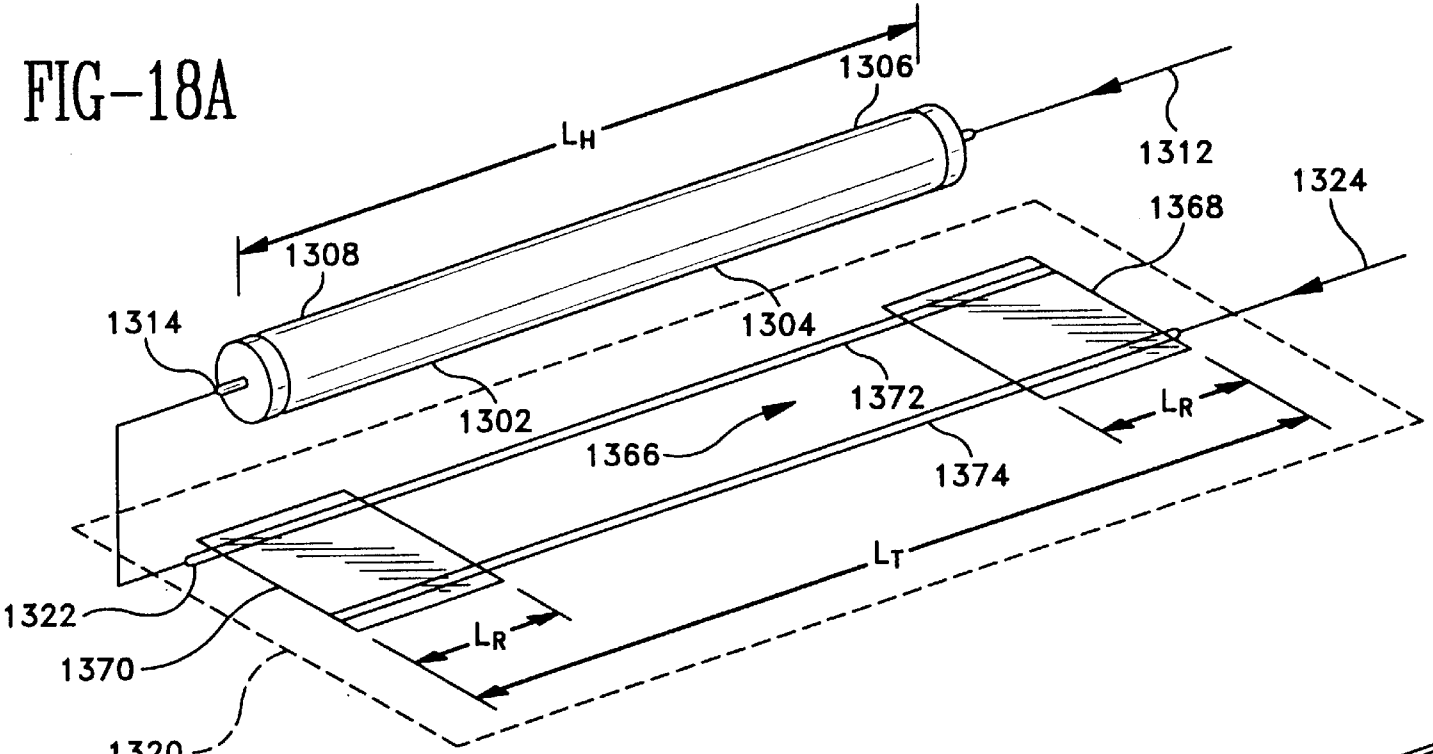
FIG. 18A shows an alternative inductive structure for use with the present invention.
Figure 18B:
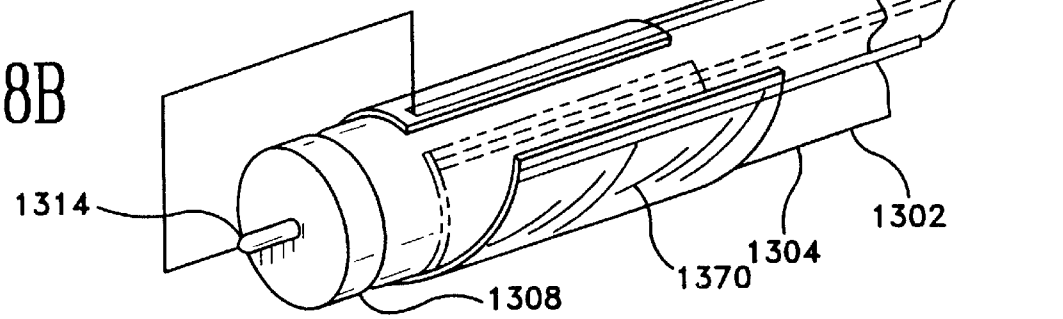
FIG. 18B shows a preferred manner of construction for applying the inductive structure of FIG. 18A.

Referring now to FIGS. 18A and 18B, there is shown an alternative embodiment of inductive structure according to the present invention which is suitable for use with the circuit shown in FIG. 17. The inductive structure of FIGS. 18A and 18B is referred to as a "segmented electron exciter". It is to be understood that, while the configuration of FIGS. 18A and 18B is envisioned for use with the circuit of FIG. 17, the circuit of FIG. 17 can employ inductive structures of any suitable type, including those disclosed previously in this application. Referring first to FIG. 18A, fluorescent bulb 1302 has first and second electrical terminals 1312 and 1314. Inductive structure 1320 includes a first substrate configured with a central gap 1366 dividing the first substrate into first and second regions 1368, 1370 respectively. Regions 1368, 1370 are respectively disposed adjacent first and second ends 1306, 1308 of the housing of lightbulb 1302.

Each of regions 1368, 1370 has a length designated as $L_R$. The total length across the ends of the first and second substrate regions is designated as $L_T$, and is essentially co-extensive with a length $L_H$ of housing 1304 of lightbulb 1302. Preferably, the length $L_R$ of each of the first and second substrate regions 1368, 1370 is at least about 12% of the length $L_H$ of housing 1304. The construction of inductive structure 1320 is otherwise similar to those described above. A first top conductor strip 1372 and a first bottom conductor strip 1374 are provided and are secured to first and second substrate regions 1368, 1370. First top conductor strip 1372 has a first exposed end forming a third electrical terminal 1322 which is electrically interconnected with second electrical terminal 1314. First bottom conductor strip 1374 has a first exposed end forming a fourth electrical terminal 1324.

Referring now to FIG. 18B, in a preferred manner of construction, substrate region such as second substrate region 1370 is secured about second end 1308 of housing 1304 of first fluorescent lightbulb 1302. First substrate region 1368 would, of course, preferably be secured in a similar fashion. It is to be understood that, rather than wrapping the substrate regions about the ends of the bulb, they could also be provided on a flat fixture surface adjacent to the bulb (not shown). Further, the substrate could be continuous and regions 1368, 1370 could be defined by a central gap in the conductive-resistive coating. Yet further, regions 1368, 1370 could be painted onto housing 1304 of bulb 1302.

Figure 19:
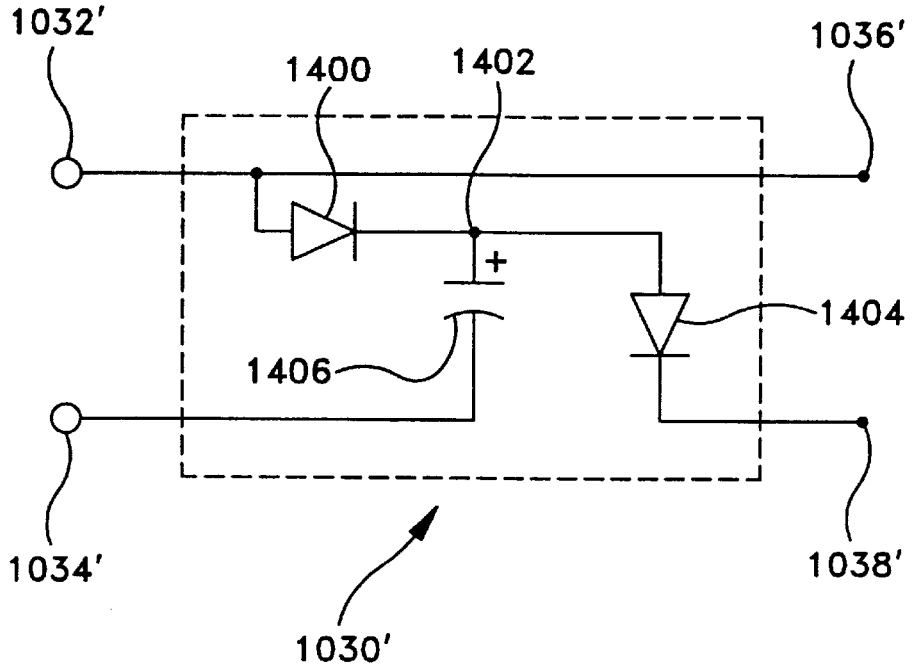
FIG-19 PRIOR ART
FIG. 19 shows a circuit diagram of a first prior art rectifier design suitable for use with the present invention.
Figure 20:
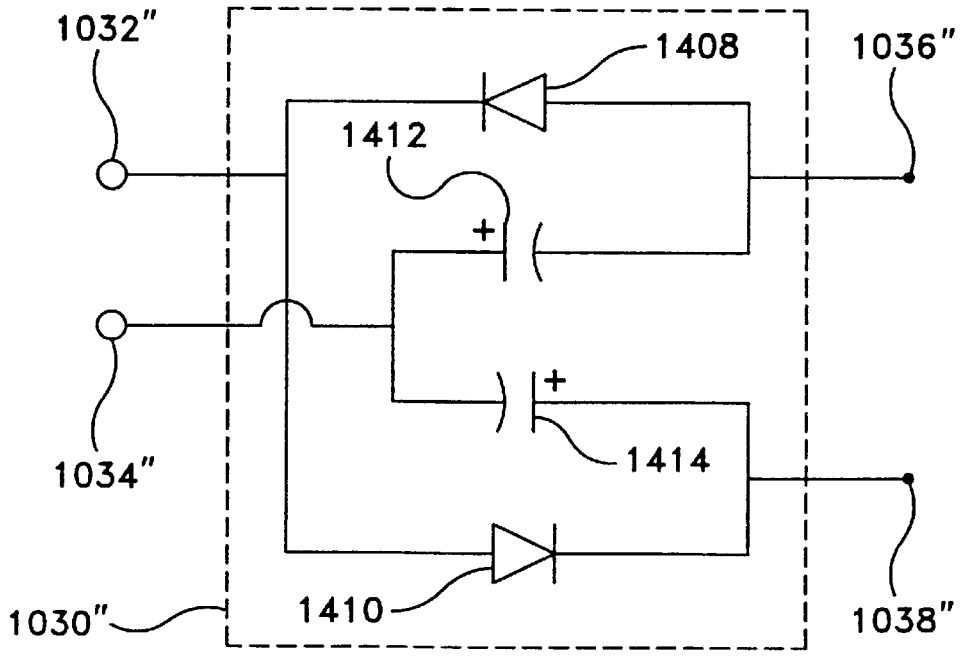
FIG-20 PRIOR ART
FIG. 20 shows a circuit diagram of a second prior art rectifier design suitable for use with the present invention.
Figure 21:
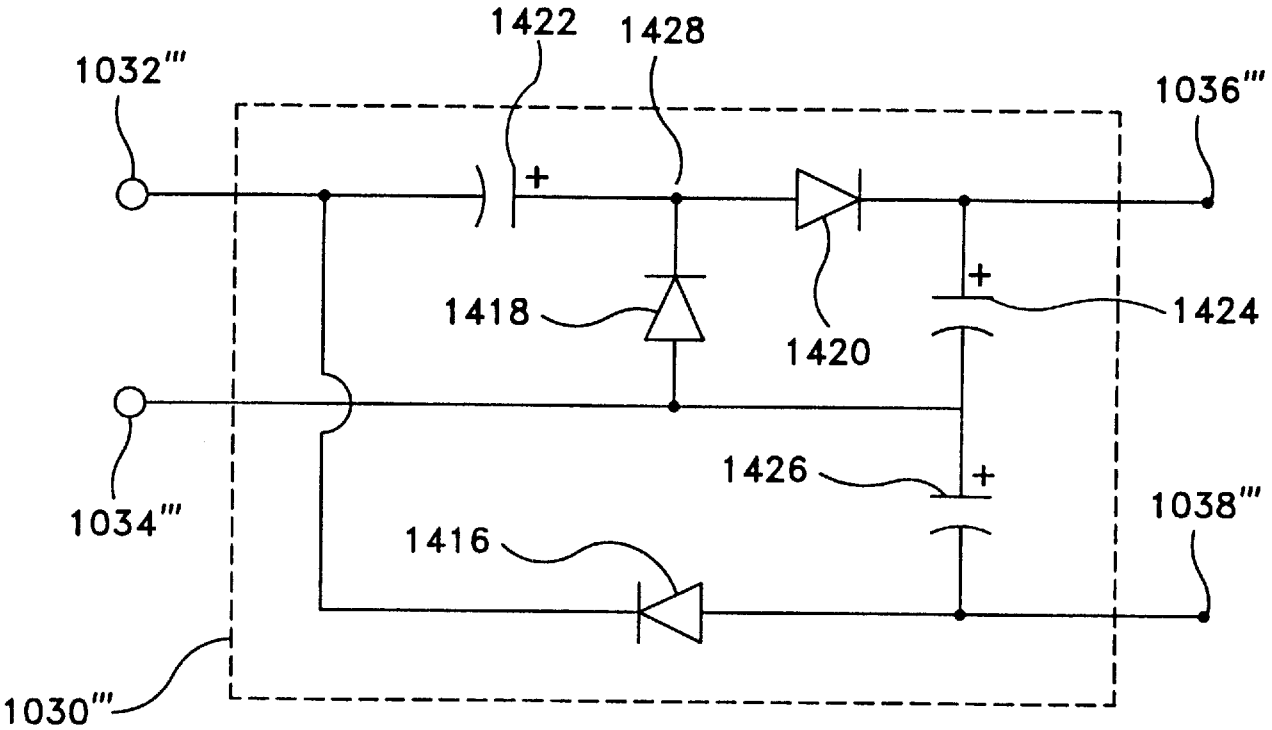
FIG-21 PRIOR ART
FIG. 21 shows a circuit diagram of a third prior art rectifier design suitable for use with the present invention.

Referring now to FIGS. 19–21, there are illustrated three prior art rectifier configurations suitable for use as sources of rippled D.C. with the present invention. It is to be understood that these three configurations are only exemplary, and any type of device which produces a direct current exhibiting a rippled/pulsed voltage at its output terminals is appropriate for use with the present invention.

Figure 22:
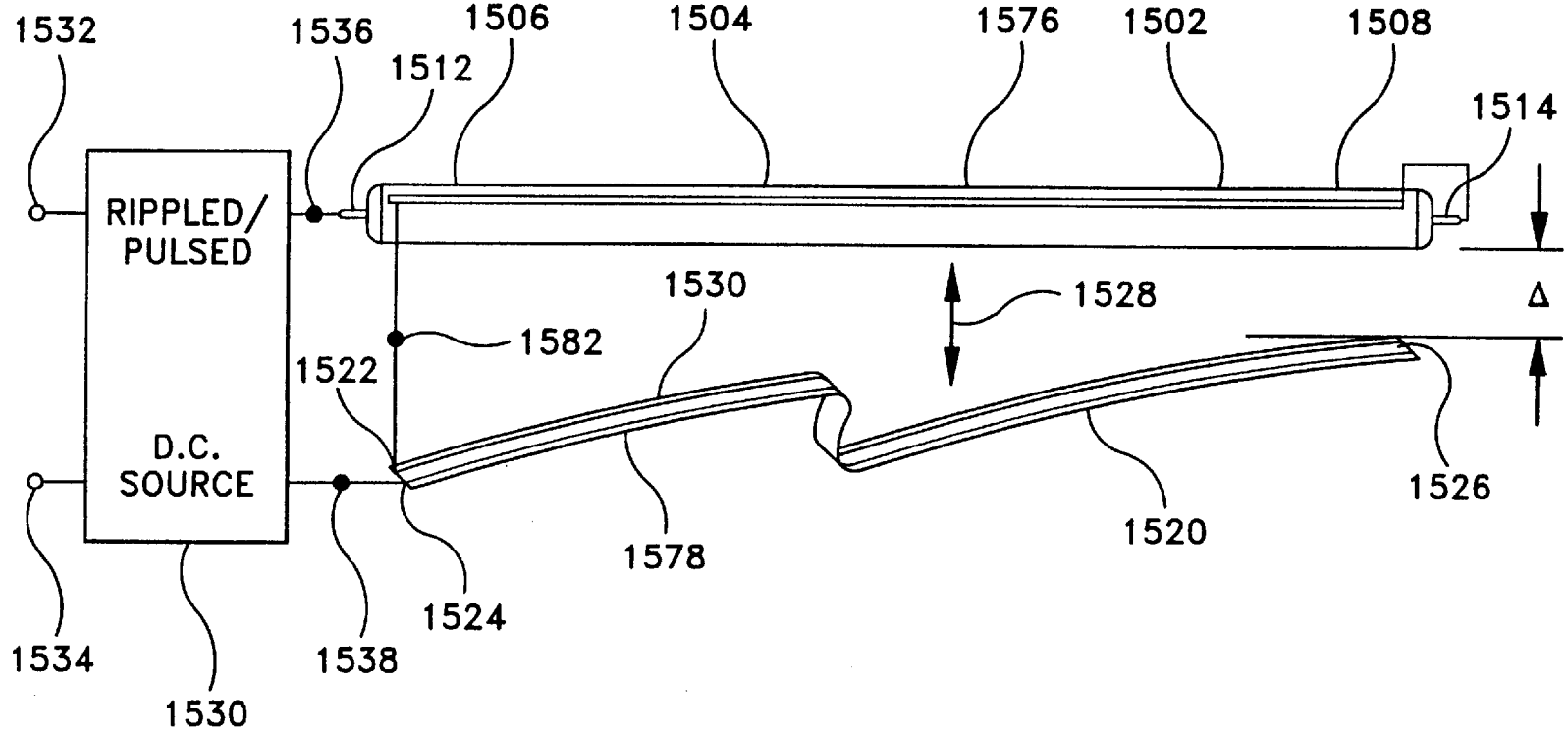
FIG. 22 is a perspective view of an embodiment of the invention wherein a conductive strip is mounted on a fluorescent bulb to enhance electromagnetic interaction.

Referring first to FIG. 19, a rectifier 1030' has first and second AC input terminals 1032', 1034' and has first and second rectifier output terminals 1036', 1038'. First AC input terminal 1032' is electrically interconnected with first rectifier output terminal 1036' to form a common terminal. Rectifier 1030' includes a first diode 1400 electrically interconnected between the common terminal formed by terminals 1032', 1036' and an intermediate node 1402 for conduction from the common terminal to the intermediate node 1402. Rectifier 1030' also includes a second diode 1404 electrically interconnected between intermediate node 1402 and second output terminal 1038' of rectifier 1030' for conduction from intermediate node 1402 to second output terminal 1038'. Rectifier 1030' further includes a polarized capacitor 1406 having its positive terminal electrically connected to intermediate node 1402 and its negative terminal electrically connected to second AC input terminal 1034'. It is to be understood that terminals 1032', 1034', 1036', 1038' may correspond to any of terminals 1032, 1034, 1036, 1038; 1132, 1134, 1136, 1138; 1232, 1234, 1236, 1238; 1332, 1334, 1336, 1338; and 1532, 1534, 1536, 1538 of FIGS. 14–17 and 22, respectively (FIG. 22 is discussed below).

Referring now to FIG. 20, there is shown a capacitor doubler circuit suitable for use as a rectifier with the present invention. Rectifier 1030" includes first and second AC input terminals 1032", 1034" respectively and first and second output terminals 1036", 1038" respectively. Rectifier 1030" includes first diode 1408 electrically connected between first output terminal 1036" and first AC input terminal 1032" for conduction from first output terminal 1036" to first AC input terminal 1032". Rectifier 1030" also includes a second diode 1410 electrically connected between second output terminal 1038" and first AC input terminal 1032" for conduction from first AC input terminal 1032" to second output terminal 1038". Rectifier 1030" further includes a first polarized capacitor 1412 having its positive terminal electrically interconnected with second AC input terminal 1034", and having its negative terminal electrically interconnected with first output terminal 1036". Finally, rectifier 1030" also includes a second polarized capacitor 1414 having its positive terminal electrically interconnected with second output terminal 1038" and its negative terminal electrically interconnected with second AC input terminal 1034". Again, it is to be understood that terminals 1032", 1034", 1036" and 1038" may correspond to any of the related source terminals depicted in FIGS. 14–17 above and FIG. 22 below.

Referring now to FIG. 21, yet another rectifier configuration suitable for use with the present invention is shown. The configuration of FIG. 21 is a capacitor tripler. Rectifier 1030'" of FIG. 21 includes a first diode 1416 electrically connected between second output terminal 1038'" and first AC input terminal 1032'" for conduction from second output terminal 1038'" to first AC input terminal 1032'". Also included in rectifier 1030'" is a second diode 1418 electrically connected between second AC input terminal 1034'" and a first intermediate node 1428 for conduction between second AC input terminal 1034'" and first intermediate node 1428. A third diode 1420 is electrically interconnected between first intermediate node 1428 and first output terminal 1036'" for conduction from first intermediate node 1428 to first output terminal 1036'".

A first polarized capacitor 1422 has its positive terminal electrically connected to first intermediate node 1428 and its negative terminal electrically connected to first AC input terminal 1032'". A second polarized capacitor 1424 has its positive terminal electrically connected to first output terminal 1036'" and its negative terminal electrically connected to second AC input terminal 1034'". Finally, third polarized capacitor 1426 has its positive terminal electrically connected to second AC input terminal 1034'" and its negative terminal electrically connected to second output terminal 1038'". Again, it is to be understood that terminals 1032'", 1034'", 1036'" and 1038'" can correspond to any of the appropriate source terminals shown in FIGS. 14–17 and 22.

FIG. 22 shows yet another embodiment of the invention, in which a conductive strip 1576 is mounted on a translucent housing 1504 of a fluorescent lightbulb 1502. Items in FIG.

22 which are similar to those in FIG. 14 have received the same reference character incremented by 500. Construction is quite similar to the embodiment of FIG. 14. For clarity, inductive structure 1520 is shown with only a single conductive-resistive coating 1526. It will be appreciated that inductive structure 1520 can be an elongate tape structure having top and bottom conductor strips 1580, 1578. In the embodiment of FIG. 22, third and fourth electrical terminals 1522, 1524 can be formed at the same end of structure 1520 for convenience, and third terminal 1522 can be electrically interconnected with strip 1576 through any convenient means, such as lead 1582. Thus, strip 1576 carries the same current which is passed through structure 1520.

It has been found that locating strip 1576 on bulb 1502 permits bulb 1502 to start at a distance Δ which is much further away from structure 1520 than would otherwise be possible (e.g., 12" instead of 1"; see Example 11 below). It is believed that this is due to electromagnetic field interaction between strip 1576 and bulb 1502, as discussed above with respect to the interaction between inductive structures and bulbs. Due to proximity of strip 1576 to bulb 1502, interaction 1528 between structure 1520 and bulb 1502 apparently becomes less important. Thus, this embodiment of the invention is preferred when inductive structure 1520 cannot be located close to lightbulb 1502. Note that distance Δ between structure 1520 and bulb 1502 is an approximate average value to be measured between structure 1520 and bulb 1502 when structure 1520 is substantially parallel to bulb 1502. Δ is shown in FIG. 22 as being measured from a corner of structure 1520 for convenience only, so that the potential flexibility of structure 1520 could be shown. Note also that, while the embodiment of FIG. 22 is shown with an "instant start" configuration, the principle of applying a conductive strip to a fluorescent lightbulb will also work with preheat embodiments of the invention, such as those shown in FIGS. 4, 5 and 10–13.

EXAMPLES

Example 1

An inductive fluorescent apparatus was constructed in accordance with FIGS. 4 and 5. Bulb 68 was a General Electric 20 watt 24 inch preheat type kitchen and bath bulb model number F20T12.KB. A McMaster-Carr number 1623K1 starter bulb was employed. An inductive structure was assembled in the form of a conductive-resistive medium and substrate assembly 58 as shown in FIG. 6. The assembly had a length of 24 inches and a width of 1.5 inches. Substrate 78 was in the form of a 0.002 inch polyester film. One-eighth inch wide by 0.002 inch thick copper conductors 88, 96 were positioned with approximately 1.25 inches between their inside edges. They were then covered with a medium temperature conductive-resistive coating, to be discussed below, to a depth of 0.008 inches wet, which dried to a thickness of 0.004 inches. The thicknesses refer to the total height of the coating 114 above the top surface of the substrate 78. The goal was to achieve a nominal DC resistance of 200 Ohms between the conductors 88, 96.

Structure 58 was maintained about 3/32 inch from the bulb and was run on a nominal 60 Hz 120 VAC line current which had an actual measured value of 117.8 VAC. Once the bulb had started, a voltage drop of 61 VAC was measured across the bulb. The bulb would not start unless maintained in proximity to the conductive-resistive medium and substrate assembly. However, once it was started, it could be removed from the region of the assembly and would remain illuminated. Thus, it is believed that the conductive-resistive medium and substrate assembly aids in starting the bulb by means of an electromagnetic field interaction with the bulb, and also acts as a series impedance to absorb excess voltage during steady-state operation of the bulb.

The conductive-resistive medium was prepared as follows. A slurry was formed consisting of 97.95 parts by weight water, 58.84 parts by weight ethyl alcohol, and 48.80 parts by weight GP-38 graphite 200–320 mesh as sold by the McMaster-Carr supply Company, P.O. Box 440, New Brunswick, N.J. 08903-0440. 52.38 parts by weight of polyvinyl acetate 17-156 heater emulsion, available from Camger Chemical Systems, Inc. of 364 Main Street, Norfolk, Mass. 02056, were blended into the aforementioned slurry. Finally, 35.09 parts by weight of China Clay available from the Albion Kaolin Company, 1 Albion Road, Hephzibah, Ga. 30815 were added to the blended slurry mixture. The mixture was then applied to the substrate and allowed to dry, leaving an emulsion of graphite and china clay dispersed in polyvinyl acetate polymer.

Example 2

Another example was constructed in accordance with FIGS. 4 and 5, and using a conventional fluorescent fixture with the ballast removed. The conductive-resistive medium and substrate assembly 58 was assembled to the fixture on the top 124 of the housing assembly 126 of the fixture, as shown in FIG. 8. The metal of the housing 126 was ferromagnetic. A GE F20T12.CW 24 inch 20 watt cool white preheat type bulb was employed. The inductive structure was maintained approximately 3/16 of an inch away from the bulb. The inductive structure measured approximately 2 5/16 by 26½ inches, with the copper conductor strips (similar to those used in Example 1) spaced about 1 13/16 of an inch inside edge to inside edge. A dry coating thickness of 0.004 inches was used to obtain a DC resistance of 282 Ohms. The same composition of conductive-resistive material was employed as in Example 1. The example operated successfully.

Example 3

Again, in this example, the apparatus was assembled in accordance with FIGS. 4 and 5. In accordance with FIG. 9, conductive-resistive medium and substrate assembly 58 was applied to the underside 128 of the housing assembly 126 of the fixture. The tape was maintained approximately 3/32 of an inch plus the thickness of the fixture (approximately 1/64 of an inch) from the bulb. The inductive structure was essentially similar to that used in Example 2, with the copper conductors being spaced approximately 1¾ of an inch inside edge to inside edge. The metal of the housing 126 of the fixture was, again, ferromagnetic. The example operated successfully.

Example 4

An embodiment of the invention was constructed in accordance with FIG. 10. Starter bulb 212 was a McMaster-Carr number 1623K2. The bulb was a Philips F40/CW 40 watt, 48 inch preheat type bulb marked "USA 4K 4L 4M". The step-up transformer 240 was a unit which came with the fixture which was used, and which produced 240 VAC from standard line voltage. Dimmer 234 was a Leviton 600 watt, 120 VAC standard incandescent dimmer. The high-impedance conductive-resistive coating 214 had a nominal 1000 Ohm DC resistance value and was formed from 3M "Scotch Brand" recording tape, 2 inch wide, number 0227-003. This product is known as a studio recording tape.

Copper foil strips having a conductive adhesive on the reverse (available from McMaster-Carr Supply Company of New Brunswick, N.J.) were attached to the back side of the recording tape and were laminated with an insulative polyester film and an acrylic adhesive. The low-impedance conductive-resistive coating 230 had a nominal 200 Ohm value and was formed using the composition discussed in the above examples. The coating 230 was applied to a tape structure which was mounted on the underside of the magnetic recording tape. The assembled inductive structure was located about ⅜ of an inch from the surface of the bulb 168. The inductive structure was located under the metal of the fixture as shown in FIG. 9. Essentially continuous dimming of lamp 168 was possible when the apparatus of Example 4 was tested.

Example 5

A self-dimming example of the invention was constructed in accordance with the circuit diagram of FIG. 13. Bulb 568 was an Ace F20 T12.CW USA cool white 24 inch preheat model bearing the label UPC 0 82901-30696 2. Starter bulbs 612, 712 were both of the McMaster-Carr number 1623K1 variety. Resistor 708 was a Radio Shack 3.3 kΩ rated at ½ watt. Diode 714 was a Radio Shack 1.5 kV, 2.5 amp diode. Polarized capacitor 710 had a capacitance of 10 μF and was rated for 350 volts. The photoresistor 706 was of a type available from Radio Shack having a resistance of 50 Ohms in full light conditions and $10^6$ Ohms in full dark conditions. Control relay 704 was a Radio Shack model number SRUDH-S-1096 single pole double throw miniature printed circuit relay having a 9 volt DC, 500 Ohm coil with contacts rated for 10 amps and 125 VAC.

The inductive structure included a nominal 100 Ohm low-impedance conductive-resistive coating 630 and a nominal 2500 Ohm high-impedance conductive-resistive coating 614. The low-impedance and high-impedance coatings were assembled on separate substrates which were then applied one on top of the other. The example according to FIG. 13 was assembled and was operated successfully. Bulb 568 dimmed when photoresistor 706 was exposed to high ambient light. When photoresistor 706 was shielded from ambient light, and thus was in a relatively dark environment, bulb 568 burned at full intensity.

Example 6

An "instant-start" example of the invention was constructed in accordance with FIGS. 14 and 20. The bulb was a Philips F20T12/CW 24 inch preheat type bulb which had burned out filaments. Electrical connections were made to one pin only at each end, whichever pin was connected to the biggest remaining stub of the burned-out electrode. The source 1030 was a rectifier assembled in accordance with FIG. 20 using two Atom model TVA-1503 USA 9541H+85° C. 185° F.+8 μF 250 VDC capacitors. Two PTC205 1 kV 2.5 ampere diodes were employed. Ordinary AC line voltage of 120 VAC, 60 Hz was applied across terminals 1032", 1034". 157 VDC was measured across terminals 1036", 1038". This DC voltage exhibited a ripple component such that a frequency of 120 Hz was measured with a frequency meter for the nominal DC signal.

A single inductive structure constructed from a 1⅛ inch× 22½ inch piece of magnetic recording tape and having a nominal DC resistance of 1 kΩ (0.695 kΩ measured) was employed. The structure employed two 0.002 inch by ⅛ inch copper foils located near the edges of the recording tape, which were electrically connected, with a third strip between them (providing two parallel current paths between outside and inner strip). The spacing between strips was about ⅓ inch. A polyester film with acrylic adhesive was applied over the foils. The exemplary embodiment operated successfully.

Example 7

An example of the invention was constructed in accordance with FIGS. 16 and 21. A capacitor tripler in accordance with FIG. 21 had a first capacitor 1422 with a capacitance of 40 μF rated at 150 volts; a second capacitor 1424 with a capacitance of 22 μF rated at 250 volts; and a third capacitor 1426 with a capacitance of 40 μF rated at 150 volts. Diodes 1416, 1418 and 1420 were all 1.5 kV, 2.5 ampere diodes. Bulbs 1202, 1256 were both GE F4AT12CW 48 inch bipin (instant-start) type.

The inductive structure 1220 was fabricated from 2 separate pieces of 3M "Scotch Brand" 0227-003 two inch wide studio recording tape mounted on a rigid, non-conducting base. The main piece measured 2 inches by 48 inches and had five copper conductor foils located on it. The outer foils were located approximately 1/16 of an inch from the edges. The foils were spaced about 9/32 inches apart. A nominal DC resistance of 1.5 kΩ was present between each foil. Accordingly, nominal values of 1.5, 3, 4.5 and 6 kΩ were available from the main piece. An extra piece of magnetic recording tape, also 2 inches wide, and having a length of 31 inches had two copper foils located near its edges and spaced 1 9/16 inch apart, and was selectively connectable in series with the last foil of the main tape so that the overall nominal resistance values available were 1.5, 3, 4.5, 6 and 10 kΩ ($Z_1$–$Z_5$). Measured values were 1.29, 2.51, 3.92, 5.09 and 12.82 kΩ. The exemplary embodiment operated successfully.

Example 8

An example of the invention was constructed essentially in accordance with FIGS. 15 and 20, except that only two extra conductive-resistive coatings 1150, 1152 were employed (instead of three as in FIG. 15), and they were each selectively connectable in series with primary structure 1148, but not in parallel with each other as in FIG. 15. The bulb was a circular "Lights of America" FC8T9/WW/RS preheat type, with only one pin at each end of the bulb connected. The main inductive structure 1148 was a ½ inch wide strip of conductive-resistive material (the same composition as in Example 1) which was painted directly on the light in order to obtain a nominal 50 Ohm DC resistance between the ⅛ inch wide copper conductors, which were located essentially adjacent the side edges of the strip of conductive material. The material was painted over essentially the entire circumference of the circular fluorescent lightbulb. The rippled/pulsed D.C. source was a rectifier which employed two 1.5 kV, 2.5 ampere diodes number 1N5396, and two identical Atom TVA-1504 capacitors, having capacitances of 10 μF, rated at 250 VDC, and marked USA 9526H+85° C. 185° F.+.

Coatings 1150, 1152 were formed on the same piece of 3M "Scotch Brand" (0227-003) 2 inch wide studio recording tape. The tape was about 8½ inches long. Five copper foil conductors were spaced across the tape with about 5/16" between them. The second and fourth foils were connected, as were the third and fifth foils, such that an effective length of about twice 8½", or 17 inches, was present between them. Coating 1150 was located between foils 1 and 2, and had a D.C. resistance of about 7.5 kΩ, while coating 1152 was located between foils 2–4 and 3–5, with a D.C. resistance of about 3.7 kΩ. The exemplary apparatus could be easily adapted to a fixture intended for a three-way incandescent socket with switching as shown in FIG. 15. The tape including the extra conductive-resistive coatings could be wrapped around a circular portion of the fixture which screws into the socket.

Example 9

Another example of the invention was constructed in accordance with FIG. 14 and FIG. 19. The rectifier of FIG. 19 included a single 10 μF capacitor and two 1 kV, 2.5 ampere diodes. 120 VAC line voltage was stepped up to 220 VAC and applied to terminals 1032', 1034'. The bulb was a Philips Econ-O-Watt FB40CW/6/EW 40 watt u-shaped preheat type, with only one pin at each end connected. The inductive structure was ⅝ inch wide recording tape applied to the entire outside circumference of the lightbulb. Only a single tape, corresponding to impedance $Z_1$ (reference number 1026) was employed. The ⅝ inch wide strip of recording tape was cut down from 3M "Scotch Brand" (0227-003) 2 inch wide studio recording tape and there was approximately 5/16 of an inch spacing between the inside edges of the copper conductors. The bulb operated successfully when 120 VAC stepped up to 220 VAC was applied at terminals 1032', 1034'. The nominal DC resistance of the inductive structure was about 1000 Ohms. The exemplary embodiment operated successfully. When the invention was tested with a 100 μF capacitor instead of a 10 μF capacitor, the lightbulb exhibited undesirable strobing effects, and the inductive structure overheated. It is believed that strobing could also be alleviated by employing a capacitor tripler circuit, such as that shown in FIG. 21, instead of the rectifier of FIG. 19.

Example 10

A preheat example of the invention was constructed in accordance with FIG. 12. The bulb 368 was a Philips F40/CW 40 watt 4K 4L 4M 48 inch preheat type. Switch 444 was a double pole single throw type. A transformer was used to step up the input voltage from 120 to 220 VAC. The transformer was a Franzus Travel Classics 50 watt reverse electricity converter distributed by Franzus Company, West Murtha Industrial Park, Beacon Falls, Conn. 06043. 3M "Scotch Brand" 0227-003 2 inch wide magnetic recording tape, cut down to 1 inch wide, was used to form high-impedance conductive-resistive coating 414. The length was approximately 48 inches. ⅛ inch copper conductor strips were positioned close to the opposed edges of the cut-down tape. A nominal DC resistance of 1000 Ohms was used. The low-impedance coating 430 was formed from the conductive-resistive mixture discussed above, and had a nominal 400 Ohm DC resistance. The exemplary embodiment of the invention operated successfully.

Example 11

An example of the invention was constructed in accordance with FIGS. 21 and 22. Bulb 1502 was a 72 inch instant-start bulb operated at 48 watts. First, second and third diodes 1416, 1418, 1420 of the rectifier used as source 1530 were 1 kV, 2.5 Ampere models. First capacitor 1422 was a Sprague 10 μF 250 V model; second capacitor 1424 was a Mallory 10 μF 300 V model; and third capacitor 1426 was a Mallory 33 μF 100 V model. 110 VAC at 60 Hz was supplied to terminals 1032''',1034''' with 310 VDC resulting at terminals 1036''', 1038'''. The D.C. had a "pulse" or "ripple" component such that a frequency meter recorded 60 Hz. Conductive foil 1576, which was similar to those used in Example 1, was applied to the lightbulb 1502 as shown. Bulb 1502 would start and remain illuminated when kept a distance A which was about 12" away from structure 1520. Without foil 1576, bulb 1502 had to be maintained within about 1" of structure 1520 to start.

Example 12

A 300 Ω, 24" inductive tape structure was fabricated, and was mounted on a non-ferromagnetic surface. This structure would only illuminate a fluorescent lamp when maintained within about ¼" of the lamp. When the inductive structure was instead mounted on a 24" long, 4" wide×2" high U-shaped fixture made of a thin ferromagnetic material, the lamp could be illuminated when placed within 2" of the structure. This was true when the tape was placed on any surface of the fixture. This example is believed to illustrate the "focusing" effect.

Example 13

A standard transformer type wire ballast from a "Lights of America" fixture was tested with a GE 24 inch 20 watt preheat type bulb. The ballast was marked "120 V 60 Hz 0.36 Amps for 14, 15, 18 and 20 W straight tube only catalog No. LC-14-20-C." During steady-state operation, with 115 VAC (RMS) line voltage applied to the ballast/bulb assembly, a current draw of 0.30 Amperes (RMS) for the assembly was noted. The same bulb was then tested in an embodiment of the present invention according to FIG. 5, with a 300Ω inductive structure. During steady-state operation with 115 VAC (RMS) line current, the same light output was visually observed as with the ballast. However, the current draw of the bulb and inductive structure was only 0.18 Amperes (RMS). With the same line voltage and assuming an identical power factor, the power is proportional to the RMS current drawn, so that the percent energy savings is equal to:

$$((I_1-I_2)/I_1)\times 100,$$

where $I_1$=line current with ballast and $I_2$=line current with present invention. This results in a potential 40% savings, depending on the actual power factors.

While there have been described what are presently believed to be the preferred embodiments of the invention, those skilled in the art will realize that various changes and modifications may be made to the invention without departing from the spirit of the invention, and it is intended to claim all such changes and modifications as fall within the scope of the invention.

What is claimed is:

1. A fluorescent illuminating apparatus comprising:

a translucent housing having a chamber for supporting a fluorescent medium and having electrical connections thereon to provide an electrical potential across said chamber;

a fluorescent medium supported in said chamber; and an inductive structure fixed sufficiently proximate said housing to induce fluorescence in said fluorescent medium when a low frequency electric current is passed through said inductive structure while an electric potential is applied across said housing.

2. The apparatus of claim 1, wherein said inductive structure includes:

first and second spaced conductors; and a conductive-resistive medium electrically interconnected between said spaced conductors.

3. The apparatus of claim 2, wherein said conductive-resistive medium is a graphite composite comprising powdered graphite and an alkali silicate dispersed in a polymeric binder.

4. The apparatus of claim 3, wherein:

said translucent housing has a surface; and said conductive-resistive medium is applied to a portion of said surface of said housing.

5. The apparatus of claim 2, wherein said conductive-resistive medium comprises a non-continuous electrically conductive component suspended in a substantially non-conductive binder.

6. The apparatus of claim 2, wherein said conductive-resistive medium is a coating portion of a magnetic recording tape.

7. The apparatus of claim 2, further comprising a conductive strip mounted on said translucent housing, said conductive strip being electrically interconnected with said inductive structure to carry said electric current.

8. The apparatus of claim 1, wherein said translucent housing is a hollow tube having inside and outside surfaces, said inside surface being coated with said fluorescent medium, said fluorescent medium being a fluorescent powder, said apparatus further comprising:

first and second electrodes disposed within said tube in a spaced-apart relationship, said electrodes being electrically interconnected with said electrical connections; and a quantity of gaseous material contained within said tube, said gaseous material being capable of emitting ultraviolet radiation when struck by electrons emanating from one of said electrodes, said fluorescent powder fluorescing in response to said ultraviolet radiation.

9. The apparatus of claim 2, wherein said inductive structure induces said fluorescence at least in part by means of an electromagnetic field interaction with at least one of said gaseous material and said fluorescent medium.

10. The apparatus of claim 1, wherein:

said inductive structure is configured to generate heat in response to said electric current; and said inductive structure is disposed in thermal communication with said translucent housing for transmission of at least a portion of said heat thereto, said heat aiding in low-ambient-temperature operation of said fluorescent illuminating apparatus.

11. The apparatus of claim 1, wherein:

said translucent housing has an exterior surface; and said inductive structure is generally positioned within about one inch or less of said exterior surface of said translucent housing.

12. The apparatus of claim 1, wherein:

said translucent housing is elongate; and said inductive structure is substantially coextensive with said translucent housing.

13. The apparatus of claim 1, wherein:

said translucent housing has first and second ends and said housing and said fluorescent medium form part of a preheat-type fluorescent lightbulb;

said electrical connections on said housing include first, second, third and fourth electrical terminals;

said lightbulb includes first and second electrodes located respectively at said first and second ends of said translucent housing, said first electrode being electrically connected between said first and second terminals, said second electrode being electrically connected between said third and fourth terminals; and said inductive structure is a first elongate tape structure including:

a first substrate having a top edge and a bottom edge;

a first top conductor strip secured to said first substrate adjacent said top edge and having a first exposed end forming a fifth electrical terminal, said fifth and fourth electrical terminals being electrically interconnected;

a first bottom conductor strip secured to said first substrate adjacent said bottom edge and having a first exposed end forming a sixth electrical terminal; and a first conductive-resistive coating located on said first substrate and electrically interconnected with said first top and first bottom conductor strips;

said apparatus further comprising:

a first starter switch electrically interconnected between said second and third electrical terminals.

14. The apparatus of claim 13, wherein said conductive-resistive coating is a coating portion of a magnetic recording tape.

15. The apparatus of claim 13, wherein said conductive-resistive coating is a graphite composite comprising powdered graphite and an alkali silicate dispersed in a polymeric binder.

16. The apparatus of claim 13, wherein a thin metallic plate is interposed between said elongate tape structure and said lightbulb to enhance electromagnetic interaction between said tape and said bulb.

17. The apparatus of claim 13, wherein said inductive structure also includes a second elongate tape structure, said second elongate tape structure including:

a second substrate having a top edge and a bottom edge;

a second top conductor strip secured to said second substrate adjacent said top edge and having a first exposed end electrically interconnected with said fifth electrical terminal;

a second bottom conductor strip secured to said second substrate adjacent said bottom edge and having a first exposed end forming a seventh electrical terminal; and a second conductive-resistive coating located on said second substrate and electrically interconnected with said second top and second bottom conductor strips, said first and second conductive-resistive coatings being selected for effective dimming of said lightbulb;

said apparatus further comprising a dimmer electrically interconnected between said sixth and seventh electrical terminals.

18. The apparatus of claim 17, further comprising:

a resistor; and a second starter switch in series with said resistor, said resistor and said second starter switch being electrically interconnected between said fourth and sixth electrical terminals, said resistor being selected to permit starting of said bulb at a relatively dim light level.

19. The apparatus of claim 13, wherein said inductive structure also includes a second elongate tape structure, said second elongate tape structure including:

a second substrate having a top edge and a bottom edge;

a second top conductor strip secured to said second substrate adjacent said top edge and having a first exposed end forming a seventh electrical terminal;

a second bottom conductor strip secured to said second substrate adjacent said bottom edge and having a first exposed end forming an eighth electrical terminal; and a second conductive-resistive coating located on said second substrate and electrically interconnected with said second top and bottom conductor strips, said second conductive-resistive coating being selected along with said first conductive-resistive coating for dimming of said lightbulb when only said first elongate tape structure is in circuit;

said apparatus further comprising a light-responsive switch for connecting said second elongate tape structure in parallel with said first elongate tape structure in response to relatively high ambient light levels, said second elongate tape structure being connected in parallel with said first elongate tape structure by connecting said seventh and eighth electrical terminals between said fourth and sixth electrical terminals.

20. The apparatus of claim 13, wherein said inductive structure also includes a second elongate tape structure, said second elongate tape structure including:

a second substrate having a top edge and a bottom edge;

a second top conductor strip secured to said second substrate adjacent said top edge and having a first exposed end electrically interconnected with said fifth electrical terminal;

a second bottom conductor strip secured to said second substrate adjacent said bottom edge and having a first exposed end forming a seventh electrical terminal; and a second conductive-resistive coating located on said second substrate and electrically interconnected with said second top and second bottom conductor strips, said second conductive-resistive coating being selected for ease in starting said lightbulb, said first conductive-resistive coating being selected for efficient steady-state operation of said lightbulb;

said apparatus further comprising a second starter switch electrically interconnected between said sixth and seventh electrical terminals.

21. The apparatus of claim 19, wherein said first and second starter switches are configured to operate simultaneously, each as one pole of a double pole, single throw pushbutton type switch.

22. The apparatus of claim 1, wherein:

said translucent housing has first and second ends and said housing and said fluorescent medium form part of a first fluorescent lightbulb;

said electrical connections on said housing include first and second electrical terminals;

said lightbulb includes first and second electrodes located respectively at said first and second ends of said translucent housing, said first and second electrodes being respectively electrically interconnected with said first and second electrical terminals; and said inductive structure is a first elongate tape structure including:

a first substrate having a top edge and a bottom edge;

a first top conductor strip secured to said first substrate adjacent said top edge and having a first exposed end forming a third electrical terminal, said second and third electrical terminals being electrically interconnected;

a first bottom conductor strip secured to said first substrate adjacent said bottom edge and having a first exposed end forming a fourth electrical terminal; and a first conductive-resistive coating located on said first substrate and electrically interconnected with said first top and first bottom conductor strips; said apparatus further comprising a source of rippled/pulsed direct current having two output terminals, a first of said output terminals of said source being electrically connected to said first electrical terminal, a second of said output terminals of said source being electrically connected with said fourth electrical terminal, said source being electrically configured to produce a direct current exhibiting a rippled/pulsed voltage between said output terminals.

23. The apparatus of claim 22, wherein said source is a capacitor doubler rectifier having first and second A.C. input terminals, said rectifier comprising:

a first diode electrically connected between said first output terminal and a first of said a.c. input terminals for conduction from said first output terminal to said first a.c. input terminal;

a second diode electrically connected between said second output terminal and said first a.c. input terminal for conduction from said first a.c. input terminal to said second output terminal;

a first polarized capacitor having first positive and first negative terminals, said first positive terminal being electrically interconnected with a second of said a.c. input terminals, said first negative terminal being electrically interconnected with said first output terminal; and a second polarized capacitor having second positive and second negative terminals, said second positive terminal being electrically interconnected with said second output terminal, said second negative terminal being electrically interconnected with said second a.c. input terminal.

24. The apparatus of claim 23, wherein said inductive structure also includes at least a second elongate tape structure, said second elongate tape structure including:

a second substrate having a top edge and a bottom edge;

a second top conductor strip secured to said second substrate adjacent said top edge and having a first exposed end forming a fifth electrical terminal;

a second bottom conductor strip secured to said second substrate adjacent said bottom edge and having a first exposed end forming a sixth electrical terminal; and a second conductive-resistive coating located on said second substrate and electrically interconnected with said second top and second bottom conductor strips; said apparatus further comprising a switch configured to selectively electrically interconnect said fifth and sixth electrical terminals between said second electrical terminal and said second output terminal of said rectifier.

25. The apparatus of claim 22, wherein said source is a capacitor tripler rectifier having first and second A.C. input terminals, said rectifier comprising:

a first diode electrically connected between said second output terminal and a first of said a.c. input terminals for conduction from said second output terminal to said first a.c. input terminal;

a second diode electrically connected between a second of said a.c. input terminals and a first intermediate node for conduction from said second a.c. input terminal to said first intermediate node;

a third diode electrically connected between said first intermediate node and said first output terminal for conduction from said first intermediate node to said first output terminal;

a first polarized capacitor having first positive and first negative terminals, said first positive terminal being electrically connected to said first intermediate node, said first negative terminal being electrically connected to said first a.c. input terminal;

a second polarized capacitor having second positive and second negative terminals, said second positive terminal being electrically connected to said first output terminal, said second negative terminal being electrically connected to said second a.c. input terminal; and a third polarized capacitor having third positive and third negative terminals, said third positive terminal being electrically connected to said second a.c. input terminal, said third negative terminal being electrically connected to said second output terminal.

26. The apparatus of claim 25, wherein said inductive structure also includes at least a second elongate tape structure, said second elongate tape structure including:

a second substrate having a top edge and a bottom edge;

a second top conductor strip secured to said second substrate adjacent said top edge and having a first exposed end forming a fifth electrical terminal;

a second bottom conductor strip secured to said second substrate adjacent said bottom edge and having a first exposed end forming a sixth electrical terminal; and a second conductive-resistive coating located on said second substrate and electrically interconnected with said second top and second bottom conductor strips; said apparatus further comprising a switch configured to selectively electrically interconnect said fifth and sixth electrical terminals between said second electrical terminal and said second output terminal of said rectifier.

27. The apparatus of claim 25, further comprising:

a second fluorescent lightbulb having an electrical terminal A and an electrical terminal B at opposite ends thereof, said second and third electrical terminals being electrically interconnected through said second fluorescent lightbulb by having said terminal A electrically connected with said second electrical terminal and said terminal B electrically connected with said third electrical terminal; and a switch electrically interconnected between said first electrical terminal and said terminal A.

28. The apparatus of claim 22, wherein said source is a rectifier having first and second A.C. input terminals, and wherein said first a.c. input terminal of said rectifier and said first output terminal of said source are electrically interconnected to form a common terminal, and wherein said rectifier comprises:

a first diode electrically interconnected between said common terminal and an intermediate node for conduction from said common terminal to said intermediate node;

a second diode electrically interconnected between said intermediate node and said second output terminal of said rectifier for conduction from said intermediate node to said second output terminal; and a polarized capacitor having positive and negative terminals, said positive terminal being electrically connected to said intermediate node, said negative terminal being electrically connected to a second of said a.c. input terminals.

29. The apparatus of claim 1, wherein:

said translucent housing has first and second ends and said housing and said fluorescent medium form part of a first fluorescent lightbulb;

said electrical connections on said housing include first and second electrical terminals;

said lightbulb includes first and second electrodes located respectively at said first and second ends of said translucent housing, said first and second electrodes being respectively electrically interconnected with said first and second electrical terminals; and said inductive structure is a first elongate tape structure including:

a first substrate having a top edge and a bottom edge;

a first top conductor strip secured to said first substrate adjacent said top edge and having a first exposed end forming a third electrical terminal, said second and third electrical terminals being electrically interconnected;

a first bottom conductor strip secured to said first substrate adjacent said bottom edge and having a first exposed end forming a fourth electrical terminal; and a first conductive-resistive coating located on said first substrate and electrically interconnected with said first top and first bottom conductor strips;

said apparatus further comprising:

a source of rippled/pulsed direct current having positive and negative direct current (d.c.) output terminals, said source being electrically configured to produce a direct current exhibiting a rippled/pulsed voltage between said output terminals; and a double pole single throw polarity reversing switch, said reversing switch and said source being configured to apply a voltage spike to said lightbulb for starting purposes, said reversing switch having first and second positions, said reversing switch electrically connecting said positive terminal with said first electrical terminal and said negative terminal with said fourth electrical terminal in said first position, said reversing switch electrically connecting said negative terminal with said first electrical terminal and said positive terminal with said fourth electrical terminal in said second position.

30. The apparatus of claim 29, wherein said first substrate is configured with a central gap dividing said first substrate into first and second regions disposed respectively adjacent said first and second ends of said housing, each of said regions having a length of at least about 12% of a length of said housing.

31. A method of inducing fluorescence, comprising:

passing a low frequency electric current through an inductive structure adjacent a fluorescent medium in an amount sufficient to induce fluorescence in the presence of an electrical potential imposed on said fluorescing medium; and passing said current through a conductive-resistive medium electrically interconnected between first and second elongate conductors, said conductive-resistive medium and said first and second elongate conductors forming said inductive structure.

32. A method of inducing fluorescence, comprising:

passing a current through an inductive structure adjacent a fluorescing medium in an amount sufficient to induce fluorescence in the presence of an electrical potential imposed on said fluorescing medium; and passing said current through a conductive-resistive medium electrically interconnected between first and second elongate conductors, said conductive-resistive medium and said first and second elongate conductors forming said inductive structure, said conductive-resistive medium comprising a graphite composite, said graphite composite in turn comprising powdered graphite and an alkali silicate dispersed in a polymeric binder.

33. The method of claim 31, further comprising the additional step of:

maintaining said conductive-resistive medium within about 1 inch or less of said fluorescing medium.

34. The method of claim 31 wherein said step of passing said current through said inductive structure includes passing said current through a conductive-resistive medium electrically interconnected between first and second elongate conductors, said conductive-resistive medium and said first and second elongate conductors forming said inductive structure, said conductive-resistive medium comprising a coating portion of a magnetic recording tape.

35. The method of claim 31 wherein said step of passing said current through said inductive structure includes passing said current through a conductive-resistive medium electrically interconnected between first and second elongate conductors, said conductive-resistive medium and said first and second elongate conductors forming said inductive structure, said conductive-resistive medium comprising a graphite composite, said graphite composite in turn comprising powdered graphite and an alkali silicate dispersed in a polymeric binder.

36. A fluorescent illuminating apparatus comprising:

a translucent housing having a chamber for supporting a fluorescent medium and having electrical connections thereon to provide an electrical potential across said chamber;

a fluorescent medium supported in said chamber; and an inductive structure which includes first and second spaced conductors and a conductive-resistive medium electrically interconnected between said spaced conductors, said conductive-resistive medium being a graphite composite comprising powdered graphite and an alkali silicate dispersed in a polymeric binder, said inductive structure fixed sufficiently proximate said housing to induce fluorescence in said fluorescent medium when an electric current is passed through said inductive structure while an electric potential is applied across said housing.

37. A fluorescent illuminating apparatus comprising:

a translucent housing having a chamber for supporting a fluorescent medium and having electrical connections thereon to provide an electrical potential across said chamber;

a fluorescent medium supported in said chamber; and an inductive structure which includes first and second spaced conductors and a conductive-resistive medium comprising a non-continuous electrically conductive component suspended in a substantially non-conductive binder, said conductive-resistive medium electrically interconnected between said spaced conductors, said inductive structure fixed sufficiently proximate to said housing to induct fluorescence in said fluorescent medium when an electric current is passed through said inductive structure while an electric potential is applied across said housing.

38. A fluorescent illuminating apparatus comprising:

a translucent housing having a chamber for supporting a fluorescent medium and having electrical connections thereon to provide an electrical potential across said chamber;

a fluorescent medium supported in said chamber; and an inductive structure which includes first and second spaced conductors and a conductive-resistive medium which is a coating portion of a magnetic recording tape, said conductive-resistive medium electrically interconnected between said spaced conductors, said inductive structure fixed sufficiently proximate said housing to induce fluorescence in said fluorescent medium when an electric current is passed through said inductive structure while an electric potential is applied across said housing.

39. A fluorescent illuminating apparatus comprising:

a translucent housing having a chamber for supporting a fluorescent medium and having electrical connections thereon to provide an electrical potential across said chamber, said housing having first and second ends and said housing and said fluorescent medium forming part of a preheat-type fluorescent light bulb, said electrical connections on said housing including first, second, third and fourth electrical terminals, said light bulb having first and second electrodes located respectively at said first and second ends of said translucent housing, said first electrode being electrically connected between said first and second terminals, said second electrode being electrically connected between said third and fourth terminals;

a fluorescent medium supported in said chamber;

an inductive structure fixed sufficiently proximate said housing to induce fluorescence in said fluorescent medium when an electric current is passed through said inductive structure while an electric potential is applied across said housing, said inductive structure being a first elongate tape structure, including:

a first substrate having a top edge and a bottom edge;

a first top conductor strip secured to said first substrate adjacent said top edge and having a first exposed end forming a fifth electrical terminal, said fifth and fourth electrical terminals being electrically interconnected;

a first bottom conductor strip secured to said first substrate adjacent said bottom edge and having a first exposed end forming a sixth electrical terminal; and a first conductive-resistive coating located on said first substrate and electrically interconnected with said first top and first bottom conductor strips; and a first starter switch electrically interconnected between said second and third electrical terminals.

40. A fluorescent illuminating apparatus comprising:

a translucent housing having a chamber for supporting a fluorescent medium and having electrical connections thereon to provide an electrical potential across said chamber, said translucent housing having first and second ends and said housing and said fluorescent medium forming part of a first fluorescent lightbulb, said electrical connections on said housing including first and second electrical terminals, said lightbulb including first and second electrodes located respectively at said first and second ends of said translucent housing, said first and second electrodes being respectively electrically interconnected with said first and second electrical terminals;

a fluorescent medium supported in said chamber;

an inductive structure fixed sufficiently proximate said housing to induce fluorescence in said fluorescent medium when an electric current is passed through said inductive structure while an electric potential is applied across said housing, said inductive structure being a first elongate tape structure including;

a first substrate having a top edge and a bottom edge;

a first top conductor strip secured to said first substrate adjacent said top edge and having a first exposed end forming a third electrical terminal, said second and third electrical terminals being electrically interconnected;

a first bottom conductor strip secured to said first substrate adjacent said bottom edge and having a first exposed end forming a fourth electrical terminal; and a first conductive-resistive coating located on said first substrate and electrically interconnected with said first top and first bottom conductor strips; and a source of rippled/pulsed direct current having two output terminals, a first of said output terminals of said source being electrically connected to said first electrical terminal, a second of said output terminals of said source being electrically connected with said fourth electrical terminal, said source being electrically configured to produce a direct current exhibiting a rippled/pulsed voltage between said output terminals.

41. A method of inducing fluorescence, comprising:

passing a current through an inductive structure adjacent a fluorescing medium in an amount sufficient to induce fluorescence in the presence of an electrical potential imposed on said fluorescing medium; and passing said current through a conductive-resistive medium electrically interconnected between first and second elongate conductors, said conductive-resistive medium and said first and second elongate conductors forming said inductive structure, said conductive-resistive medium comprising a coating portion of a magnetic recording tape.

* * * * *

UNITED STATES PATENT AND TRADEMARK OFFICE

CERTIFICATE OF CORRECTION

PATENT NO. : 5,834,899
DATED : November 10, 1998
INVENTOR(S) : Lovell, et al.

It is certified that error appears in the above-indentified patent and that said Letters Patent is hereby corrected as shown below:

In Column 3, Line 3, the patent now reads "itself Further"; this should read --itself. Further-- as is correctly set forth in the application on Page 5, Line 9;

In Column 9, Line 51, the patent now reads "p="; this should read --ρ=-- as is correctly set forth in the application on Page 22, Line 15;

In Column 24, Line 3, the patent now reads "A"; this should read --Δ-- as is correctly set forth in the application on Page 54, Line 3;

In Column 25, Line 5, the patent now reads "claim 3"; this should read --Claim 36-- as is correctly set forth in the Amendment of April 8, 1998, on Line 1 of Claim 4;

In Column 26, Line 18, the patent now reads "claim 13"; this should read --Claim 39-- as is correctly set forth in the Amendment of April 8, 1998, on Line 1 of Claim 14;

In Column 26, Line 21, the patent now reads "claim 13"; this should read --Claim 39-- as is correctly set forth in the Amendment of April 8, 1998, on Line 1 of Claim 15;

In Column 26, Line 25, the patent now reads "claim 13"; this should read --Claim 39-- as is correctly set forth in the Amendment of April 8, 1998, on Line 1 of Claim 16;

UNITED STATES PATENT AND TRADEMARK OFFICE

CERTIFICATE OF CORRECTION

PATENT NO. : 5,834,899
DATED : November 10, 1998
INVENTOR(S) : Lovell, et al.

It is certified that error appears in the above-indentified patent and that said Letters Patent is hereby corrected as shown below:

In Column 26, Line 29, the patent now reads "claim 13"; this should read --Claim 39-- as is correctly set forth in the Amendment of April 8, 1998, on Line 1 of Claim 17;

In Column 26, Line 56, the patent now reads "claim 13"; this should read --Claim 39-- as is correctly set forth in the Amendment of April 8, 1998, on Line 1 of Claim 19;

In Column 27, Line 14, the patent now reads "claim 13"; this should read --Claim 39-- as is correctly set forth in the Amendment of April 8, 1998, on Line 1 of Claim 20;

In Column 28, Line 8, the patent now reads "claim 22"; this should read --Claim 40-- as is correctly set forth in the Amendment of April 8, 1998, on Line 1 of Claim 23;

In Column 28, Line 50, the patent now reads "claim 22"; this should read --Claim 40-- as is correctly set forth in the Amendment of April 8, 1998, on Line 1 of Claim 25;

In Column 29, Line 44, the patent now reads "claim 22"; this should read --Claim 40-- as is correctly set forth in the Amendment of April 8, 1998, on Line 1 of Claim 28.

UNITED STATES PATENT AND TRADEMARK OFFICE

CERTIFICATE OF CORRECTION

PATENT NO. : 5,834,899
DATED : November 10, 1998
INVENTOR(S) : Lovell, et al.

It is certified that error appears in the above-identified patent and that said Letters Patent is hereby corrected as shown below:

In Column 29, Line 44, the patent now reads "claim 22"; this should read --Claim 40-- as is correctly set forth in the Amendment of April 8, 1998, on Line 1 of Claim 28.

Signed and Sealed this

Twenty-seventh Day of April, 1999

*Attest:*

*Attesting Officer*

Q. TODD DICKINSON

*Acting Commissioner of Patents and Trademarks*